US006786277B2

(12) United States Patent
Hark et al.

(10) Patent No.: US 6,786,277 B2
(45) Date of Patent: Sep. 7, 2004

(54) HEAT EXCHANGER HAVING A MANIFOLD PLATE STRUCTURE

(75) Inventors: Shin Seung Hark, Daejon-si (KR); Kim Yong Ho, Daejon-si (KR)

(73) Assignee: Halla Climate Control Corp., Taejon-Si (KR)

( * ) Notice: Subject to any disclaimer, the term of this patent is extended or adjusted under 35 U.S.C. 154(b) by 0 days.

(21) Appl. No.: 10/330,467

(22) Filed: Dec. 26, 2002

(65) Prior Publication Data

US 2003/0145981 A1 Aug. 7, 2003

Related U.S. Application Data

(62) Division of application No. 09/757,077, filed on Jan. 8, 2001, now Pat. No. 6,520,251.

(30) Foreign Application Priority Data

Jan. 8, 2000 (KR) ..... 2000-767

(51) Int. Cl.[7] ..... F28D 1/03; F28D 7/06; F25B 39/02

(52) U.S. Cl. ..... 165/178; 165/153; 165/176

(58) Field of Search ..... 165/153, 176, 165/178; 62/515

(56) References Cited

U.S. PATENT DOCUMENTS

| | | | | | |
|---|---|---|---|---|---|
| 4,258,785 | A | * | 3/1981 | Beldam | 165/153 |
| 4,800,954 | A | | 1/1989 | Noguchi et al. | 165/153 |
| 4,821,531 | A | | 4/1989 | Yamauchi et al. | 165/153 |
| 4,846,268 | A | * | 7/1989 | Beldam et al. | 165/153 |
| 4,967,834 | A | * | 11/1990 | Tokizaki et al. | 165/153 |
| 4,974,670 | A | | 12/1990 | Noguchi | 165/153 |
| 5,125,453 | A | * | 6/1992 | Bertrand et al. | 165/153 |
| 5,355,947 | A | * | 10/1994 | Rasso et al. | 165/176 |
| 5,620,047 | A | | 4/1997 | Nishishita | 165/153 |
| 5,810,077 | A | | 9/1998 | Nakamura et al. | 165/153 |
| 5,896,916 | A | | 4/1999 | Baechner et al. | 165/153 |
| 5,979,544 | A | | 11/1999 | Inoue | 165/153 |

FOREIGN PATENT DOCUMENTS

| | | | | |
|---|---|---|---|---|
| JP | 01181090 A | * | 7/1989 | 165/153 |
| JP | 06194001 A | * | 7/1994 | 62/515 |

* cited by examiner

*Primary Examiner*—Leonard R. Leo
(74) *Attorney, Agent, or Firm*—Lowe Hauptman Gilman & Berner LLP

(57) ABSTRACT

The invention relates to a heat exchanger having a manifold plate structure. The heat exchanger comprises a first and a second manifold plate. The first and second manifold plates allow a refrigerant communication between an outside of the heat exchanger and another plate. The manifold plates together form a closed flat tube and each of the manifold plates has a pair of cup portions. The first manifold plate has a first slot and the second manifold plate has a second slot. The edge of the first slot has a projected burr portion. The first slot is configured for insertion into a slot of a first adjacent plate that is configured to be connected to the first manifold plate. The length and width of the first slot are less than the length and width of the second slot.

5 Claims, 25 Drawing Sheets

HEAT EXCHANGER HAVING A MANIFOLD PLATE STRUCTURE

RELATED APPLICATIONS

This application is a division and claims priority under 35 U.S.C. §120 from U.S. patent application Ser. No. 09/757,077, filed Jan. 8, 2001 now U.S. Pat. No. 6,520,251, and which is incorporated by reference.

BACKGROUND OF THE INVENTION

1. Field of the Invention

The present invention relates generally to a plate for stack type heat exchangers and heat exchanger using such plates. In particular, the present invention relates to a plate for stack type heat exchangers and heat exchanger using such plates, which is capable of improving its performance of heat exchange by preventing the non-uniform flow distribution of refrigerant and increasing the turbulent flow effect of refrigerant, achieving its miniaturization and its optimal performance of heat exchange by designing the width of the plate and the arrangement of protrusions in accordance with an improved regularity, and improving its durability by enhancing the strength of attachment of its U-turn portion.

2. Description of the Related Technology

In general, a heat exchanger is a device in which an interior refrigerant passage is formed so that refrigerant exchanges heat with external air while being circulated through the refrigerant passage. The heat exchanger is employed in a variety of air conditioning apparatus. Particularly, in an air conditioning apparatus for automobiles, a stack type heat exchanger is mainly employed.

As depicted in FIGS. 15 to 17, a conventional stack type heat exchanger comprises of a plurality of flat tubes 90, a plurality of fins 94 and two end plates 95L, 95R.

The flat tubes 90 are stacked side by side. Each of the flat tubes 90 is formed by attaching a pair of one-tank plates 91 to each other. Each of one-tank plates 91 includes a pair of cup portions 911A, 911B, which are formed side by side on the upper portion of the one-tank plate 91 and the cup portions 911A, 911B have slots 912A, 912B respectively. A heat exchange portion 913 is formed under the cup portions to communicate with the cup portions, is provided with a plurality of small, round protrusions 915 internally projected through an embossing process, and is divided into two sub-portions by a central, longitudinal partition protrusion 917. A U-turn portion 919 is formed under the central, longitudinal partition protrusion 917 to connect the two sub-portions of the heat exchange portion 913 to each other, and is also provided with a plurality of small protrusions 915. A flange 916 is formed along the edge of the plate to have the same height as that of the small, round protrusions 915. When two one-tank plates 91 are attached to each other, a pair of pockets 93A, 93B and a U-shaped refrigerant passage are formed. The fins 94 are positioned between each pair of neighboring flat tubes 90. The end plates 95L, 95R are respectively situated at the side ends of the heat exchanger to reinforce the structure of the heat exchanger. Two cylindrical manifold portions 96L, 96R are projected from the front pocket 93A of the manifold tube 90L, 90R so as to be connected to a refrigerant inflow pipe(not shown) and a refrigerant outflow pipe(not shown), respectively.

In a conventional air conditioning apparatus employing the conventional heat exchanger as its evaporator, refrigerant enters one pocket(front pocket) 93A of the manifold tube

90L and flows into the neighboring both side front pockets 93A of the neighboring flat tubes 90 through the slots 912A of the front pockets 93A of the inlet-side tubes 90. Thereafter, the refrigerant flows to the rear pockets 93B of the inlet-side tubes 90 through a first group of U-shaped refrigerant passages of the flat tubes 90. While the refrigerant passes through the U-shaped refrigerant passages, the refrigerant exchanges heat with the exterior air. Subsequently, the refrigerant flows into the rear pocket 93B, second group of U-turn passages and front pockets 93A of the outlet-side tubes 90 through a process similar to the above-described inlet-side process. Next, the refrigerant in the pockets 93A of the outlet-side tubes 90 is discharged to a compressor through the cylindrical manifold portion 96R and the refrigerant outflow pipe. The refrigerant is evaporated in the process of heat exchange, and accordingly is supplied to the compressor in a gaseous state. A two-tank plate is similar to the one-tank plate in construction and operation except that two pairs of cup portions are respectively formed on the upper and lower end portions of the plate. Accordingly, for ease of explanation, only one-tank plate is described here.

The performance of an evaporator, which supplies cooled air into the interior of an automobile, depends upon the value of thermal conductivity by area. The performance is realized in a process in which the relatively cold refrigerant flowing through the flat tubes 90 exchanges heat with the relatively hot exterior air through the fins 94 stacked between the flat tubes 90. A heat source having a relatively high temperature is required to evaporate refrigerant, and the enlargement of a heat exchange area in contact with the fins 94 and the increase of thermal conductivity are required to improve the effect of the evaporation of refrigerant. In the case of a heat exchanger used in an air conditioning apparatus for automobiles, the high performance of heat exchange and the miniaturization of the heat exchanger are required to satisfy the requirements of the reduction of weight and noise, the increase of the amount of wind and the convenience of mounting, thus the heat exchange area of a heat exchange plate cannot be excessively enlarged.

Although a reduction in the height of the fins 94 and an increase in the density of the fins 94 are proposed to solve the above-mentioned problem, these proposals may rather decrease the performance of heat exchange due to difficulty in the drainage of condensed water, a pressure drop of exterior air and a reduction in the amount of wind.

Of the principal factors affecting the performance of heat exchange, the area of a refrigerant passage is influenced by the number, size, shape and arrangement of protrusions 915, and the intervals between protrusions. In the case of a heat exchanger having a relatively large capacity the influence of the arrangement of the protrusions 915 may be rather inconsiderable, but in the case of a compact heat exchanger comprised of flat plates each having a relatively small width the influence of the protrusions 915 is considerable. When the size of the protrusions is larger than the width of the plate by a certain ratio and the density of the protrusions is relatively small, flow resistance against the refrigerant is small but the performance of heat exchange is decreased due to the non-uniform flow distribution of refrigerant, the reduction of turbulent flow effect and the reduction of the amount of thermal contact with fins 94. When the size of the protrusions is large in comparison with the width of the plate and the density of protrusions 915 is large, the effect of the evaporation of refrigerant is decreased due to an increase in flow resistance against the refrigerant. In such cases, although a decrease in the size of protrusions can be taken into account, the decrease in the size of the protrusions is difficult to employ due to difficulty in forming a protrusion to be smaller than a certain minimum and weakness in attaching two plates to each other.

The plate 91 is generally formed of a clad brazing sheet. The plate 91 is comprised of a pair of cup portions 911A, 911B, a heat exchange portion 913 having a plurality of protrusions 915, a longitudinal partition protrusion 917 and a U-turn portion 919. Each flat tube 90 is formed by attaching two plates 91 to each other. The flat tube 90 has a pair of pockets 93A, 93B formed side by side by attaching a pair of cup portion 911A, 911B to another pair of cup portions 911A, 911B. While the refrigerant flows from the front pockets 93A to the rear pockets 93B, the refrigerant passes through the U-turn portion 919 and the flow direction of the refrigerant is reversed. In consequence, a relatively great flow pressure of the refrigerant is exerted on the U-turn portion 919 in comparison with the other portions. However, the U-turn portion of one plate 91 and the U-turn portion of the other plate 91 are attached to each other only by the attachment of the small, round protrusions 915 of the two plates 91 since the longitudinal partition protrusion 917 is not extended to the lower end of the plate 91, resulting in the weakness of attachment. Accordingly, there occurs a concern that attached small, round protrusions 915 may be easily separated from one another. When the small, round protrusions 915 are separated from one another, the high flow pressure of the refrigerant is not resisted by the small, round protrusions 915 but is concentrated on the flanges 916 of the plates 91 attached to each other and formed along the edges of the plates 91. As a result, the high flow pressure of the refrigerant cannot be resisted by the flanges 916 sufficiently, so that the flanges 916 are separated, thereby causing the leakage of the refrigerant.

The above-described phenomenon generated in the U-turn portions 919 is easily understood in FIGS. 22 to 25. FIGS. 22 to 25 are views showing the flow distributions of the refrigerant in a conventional evaporator formed of conventional heat exchange plates and mounted in a bottom mounting fashion, which were measured in 1997 using a CFD software called "Fluent".

A problem in the flow distribution of the refrigerant is that the flow of the refrigerant is concentrated on the outer portions of the plates 91. When the flow of the refrigerant is not distributed uniformly over the plates but concentrated on the outer portions of the plates, the performance of heat exchange of the heat exchanger is considerably decreased. In particular, a relatively high flow pressure of the refrigerant is exerted to the U-turn portions 919 and the longitudinal partition protrusions 917 are not extended on the lower ends of the plates 91, so that the flanges 916 beside the U-turn portions 919 of the plates 91 are caused to be under increased high flow pressure. Consequently, as shown in FIGS. 22 to 25, the flow of refrigerant is pushed to the inlet-side portion of the longitudinal partition protrusion 917 and the flange 916, so that the flow distribution of refrigerant is not uniform over the entire plate 91.

The cylindrical manifold portion 96L or 96R projected from one 93A of the two pockets of the flat tube 90 connected to the refrigerant inflow pipe or refrigerant outflow pipe is formed when a pair of manifold plates each having a semi-cylindrical manifold portion are attached to each other.

When a heat exchanger is mounted in an automobile air conditioning apparatus, there can be employed either a top mounting fashion, in which the heat exchanger is mounted to allow the pockets 93A, 93B of the heat exchanger to be situated on the top of the heat exchanger, or a bottom mounting fashion, in which the heat exchanger is mounted to allow the pockets 93A, 93B of the heat exchanger to be situated on the bottom of the heat exchanger. The characteristics of the evaporator, such as heat exchange capacity, are different, depending upon a mounting fashion, the number of tubes, the positions of the refrigerant inflow pipe and the refrigerant outflow pipe. In practice, these differences may affect the performance of an automobile air conditioning apparatus.

A 24-row type evaporator means an evaporator formed by stacking twenty four pairs of plates 91, that is, twenty four tubes 90. A 24-row type 4/7–7/4-pass evaporator means an evaporator, in which twenty four tubes 90 are stacked together and the twenty four tubes are arranged in the order of four pairs of plates 91, a pair of manifold plates 91 (i.e. a manifold tube 90L) to which the refrigerant inflow pipe is connected, seven pairs of plates 91, another seven pairs of plates 91, a pair of manifold plates 91 (i.e. a manifold tube 90R) to which the refrigerant outflow pipe is connected and four pairs of plates 91. Two reinforcing end plates 95L, 95R are situated at both ends of the evaporator, respectively. A blank plate 91C having a closed cup portion 912A is situated in the center of the evaporator, and serves as a baffle to prevent refrigerant from flowing into a neighboring plate. Therefore this blank plate 91C divides the fluid passage into a first group of U-turn passages(inflow side group) and second group of U-turn passages(outflow side group).

The following table 1 shows the performances of compact type evaporators with regard to top and bottom mounting fashions. In the case of a 13—13-pass heat exchanger, there is a 9% difference in performance between top and bottom mounting fashions. The performance data shown in the table 1 were measured using a calorimeter for evaporators.

TABLE 1

| | Bottom mounting | | | Top mounting | | |
|---|---|---|---|---|---|---|
| Pass | Calorie Q (Kcal/h) | ÄPa (mmAq) | ÄPr (Kg/cm2) | Calorie Q (Kcal/h) | ÄPa (mmAq) | ÄPr (Kg/cm2) |
| 13-13 | 4,049 | 8.68 | 0.33 | 3,715 | 9.28 | 0.27 |
| 5-7-10 | 4,190 | 13.42 | 0.51 | 4,351 | 13.75 | 0.53 |
| 4/7-4/7 | 4,238 | 9.55 | 0.40 | 4,056 | 10.41 | 0.37 |
| 3/8-4/7 | 4,091 | 9.70 | 0.37 | 4,140 | 10.02 | 0.37 |

In the above table, ÄPa means the amount of air pressure drop and ÄPr means the amount of refrigerant pressure drop.

The difference in performance is confirmed by the flow distributions of refrigerant. The flow distributions are appreciated by the distributions of temperature. The distributions of temperature, as shown in FIGS. 18 to 21, can be measured by photographs taken at a position 1 m away from the front of the evaporator using an experimental apparatus called "Air Conditioner Test Stand", which has the same structure as that of an actual automobile air conditioning apparatus and is used to aid the development of the parts of an air conditioning apparatus and a heat exchanger.

In the case of 4/7–7/4-pass evaporator, as can be referred by FIG. 19, a relatively more amount of refrigerant flows toward the blank plate rather than toward the end plate, so that the flow distribution of refrigerant is not uniform over the entire evaporator, thereby reducing the cooling performance. Additionally, the flow distributions of refrigerant are considerably different for top and bottom mounting fashions.

As indicated in FIGS. 20 and 21, in the case of 3/8–7/4-pass evaporator, the flow distributions of refrigerant are considerably different for top and bottom mounting fashions.

When the flow distribution of refrigerant is not uniform and the flow distributions of refrigerant are considerably different for top and bottom mounting fashions, a single evaporator cannot be selectively mounted in top and bottom mounting fashions. Accordingly, the evaporators should be manufactured separately according to the mounting fashions, so that the productivity of the evaporator is lowered and the manufacturing cost of the evaporator increases.

When the performance of heat exchange is reduced due to the non-uniform flow distribution of refrigerant, the cooling effect in the interior of an automobile is deteriorated, thereby causing a driver and passengers to feel hot.

The reason why the flow rate of refrigerant flowing toward the blank plate is greater than the flow rate of refrigerant flowing toward the end plate 95L is that a burr portion is not formed around the slot 912A of the cup portion 911A of the end plate-side plate 91 of two manifold plates 91 while a burr portion is formed around the slot 912A of the cup portion 911A of the blank plate-side manifold plate 91.

The burr portion serves to allow the plates 91 to be desirably attached to each other and to prevent the plates 91 from falling down while stacked plates are moved for a brazing process. On one hand, since the burr portion of the blank plate-side manifold plate 91 is inserted into the slot 912A of the neighboring blank plate-side plate 91 in the flow direction of the refrigerant while the refrigerant flows toward the blank plate 95, the refrigerant flows smoothly. On the other hand, since the burr portion of the neighboring end plate-side plate 91 is inserted into the slot 912A of the end plate-side manifold plate 91 in the opposite direction of the flow direction of the refrigerant while the refrigerant flows toward the end plate 95L, flow resistance by the burr portion is exerted on the refrigerant. Accordingly, a relatively small amount of refrigerant flows toward the end plate 95L.

As a result, the flow rate of refrigerant flowing toward the end plate 95L is less than the flow rate of refrigerant flowing toward the blank plate, so that a uniform flow distribution is not achieved over the entire evaporator. Due to the difference in flow distribution over the entire evaporator, the cooling performance is decreased and difference in flow distribution becomes great between top and bottom mounting fashions.

While, since semi-cylindrical manifold plates are formed by deep drawing of thin plates the expanded portion, particularly, the manifold portions 96 are vulnerable to outer force exerted thereon and, thus, are apt to be deformed due to bending moment from the inflow pipe or the outflow pipe.

SUMMARY OF CERTAIN INVENTIVE ASPECTS OF THE INVENTION

Accordingly, the present invention has been made keeping in mind the above problems, and one aspect of the present invention is to provide a heat exchanger having a manifold plate structure, which is capable of improving its performance of heat exchange by increasing the flowability of refrigerant.

Another aspect of the present invention is to provide a heat exchanger having a manifold plate structure, which is capable of producing a substantially constant air temperature regardless of the amount of wind by achieving the uniform flow distribution of refrigerant, thereby allowing a driver and passengers to feel cool and comfortable.

Another aspect of the present invention is to provide a heat exchanger having a manifold plate structure, which is capable of achieving its miniaturization and its optimum performance of heat exchange by designing the width of the plate and the arrangement of small, round protrusions according to an improved regularity.

Another aspect of the present invention is to provide a heat exchanger having a manifold plate structure which can enhance its durability by improving the strength of the connection portion between the manifolds and the refrigerant inflow pipe or outflow pipe.

Still another aspect of the present invention provides a heat exchanger having a manifold plate structure. The heat exchanger comprises a first end plate and a second end plate, and a plurality of flat tubes, each of the first and second end plates is configured on a respective side end of the heat exchanger. The plurality of flat tubes are stacked together so that plates constituting the flat tubes are arranged in the order of the second end plate, a first plurality of pairs of plates, a first pair of manifold plates to which a refrigerant inflow pipe is connected, the first pair of manifold plates having a first manifold plate which is located at a side of the first end plate and second manifold plate which is located at a side of the second end plate, a second plurality of pairs of plates, a second pair of manifold plates to which a refrigerant outflow pipe is connected and a third plurality of pairs of plates configured adjacent to the first end plate. The first burr portion which is projected from an edge of an inlet-side slot of the first manifold plate to an outside is fixedly inserted into a first slot of a plate among the second plurality of pairs of plates adjacent to the first manifold plate. A second burr portion which is projected from an edge of a second slot of a plate among the first plurality of pairs of plates adjacent to the second manifold plate is fixedly inserted into an inlet-side slot of the second manifold plate. Each of the length and width of the first slot and the length and width of the inlet-side slot of the first manifold plate is less than the length and width of the inlet-side slot of the second manifold plate, respectively.

Yet another aspect of the present invention provides a heat exchanger having a manifold plate structure. The heat exchanger comprises a first and a second manifold plate. The first and second manifold plates allow a refrigerant communication between an outside of the heat exchanger and another plate, the manifold plates together forming a closed flat tube and each having a pair of cup portions. The first manifold plate has a first slot and the second manifold plate has a second slot. The edge of the first slot has a projected burr portion. The first slot is configured for insertion into a slot of a first adjacent plate that is configured to be connected to the first manifold plate. The length and width of the first slot are less than the length and width of the second slot, respectively.

In this aspect of the invention, the heat exchanger further comprises a second adjacent plate having a pair of cup portions. At least one of the cup portions has a third slot having a burr portion that is projected from the edge of the third slot, and the third slot is configured for insertion into the second slot through a respective cup portion. The first slot is about 15 mm long and about 9 mm wide, while the second slot is about 16.6 mm long and about 10.8 mm wide. In this aspect of the invention, the heat exchanger further comprises a heat exchange portion and a flange. The heat exchange portion communicates with the cup portions of the manifold plates, has a plurality of small protrusions, and is divided into two sub-portions by a central longitudinal partition protrusion. The flange has the same height as that of the small protrusions and is formed along the edge of the manifold plates. Several vertical protrusions are formed side by side on an inlet-side sub-portion of the heat exchange portion under the inlet-side cup portion of the cup portions, both side vertical protrusions being respectively horizontally extended to the longitudinal partition protrusion and to a neighboring portion of the flange.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF CERTAIN EMBODIMENTS OF THE INVENTION

Figure 1:
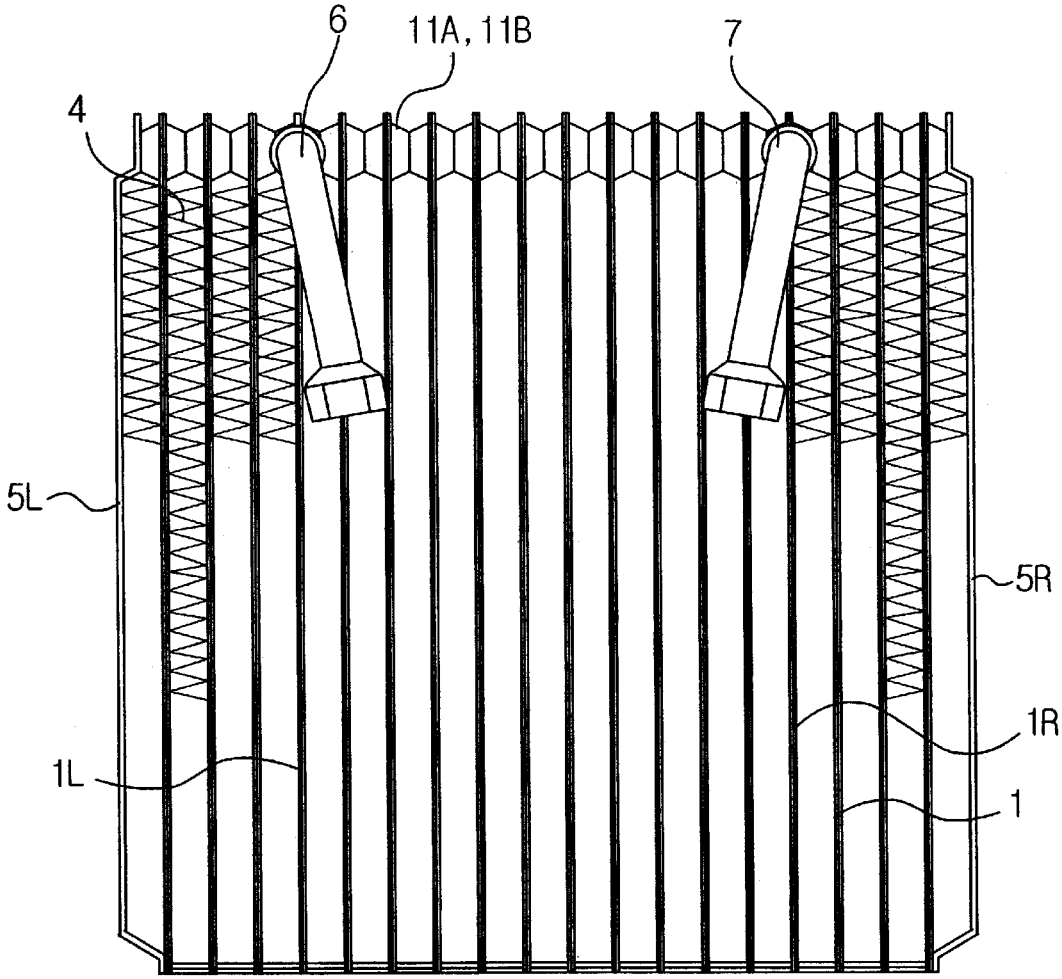
FIG. 1 is a front view showing a stack type heat exchanger in accordance with the present invention.

Reference now should be made to the drawings, in which the same reference numerals are generally used throughout the different drawings to designate the same or similar components.

Figure 2:
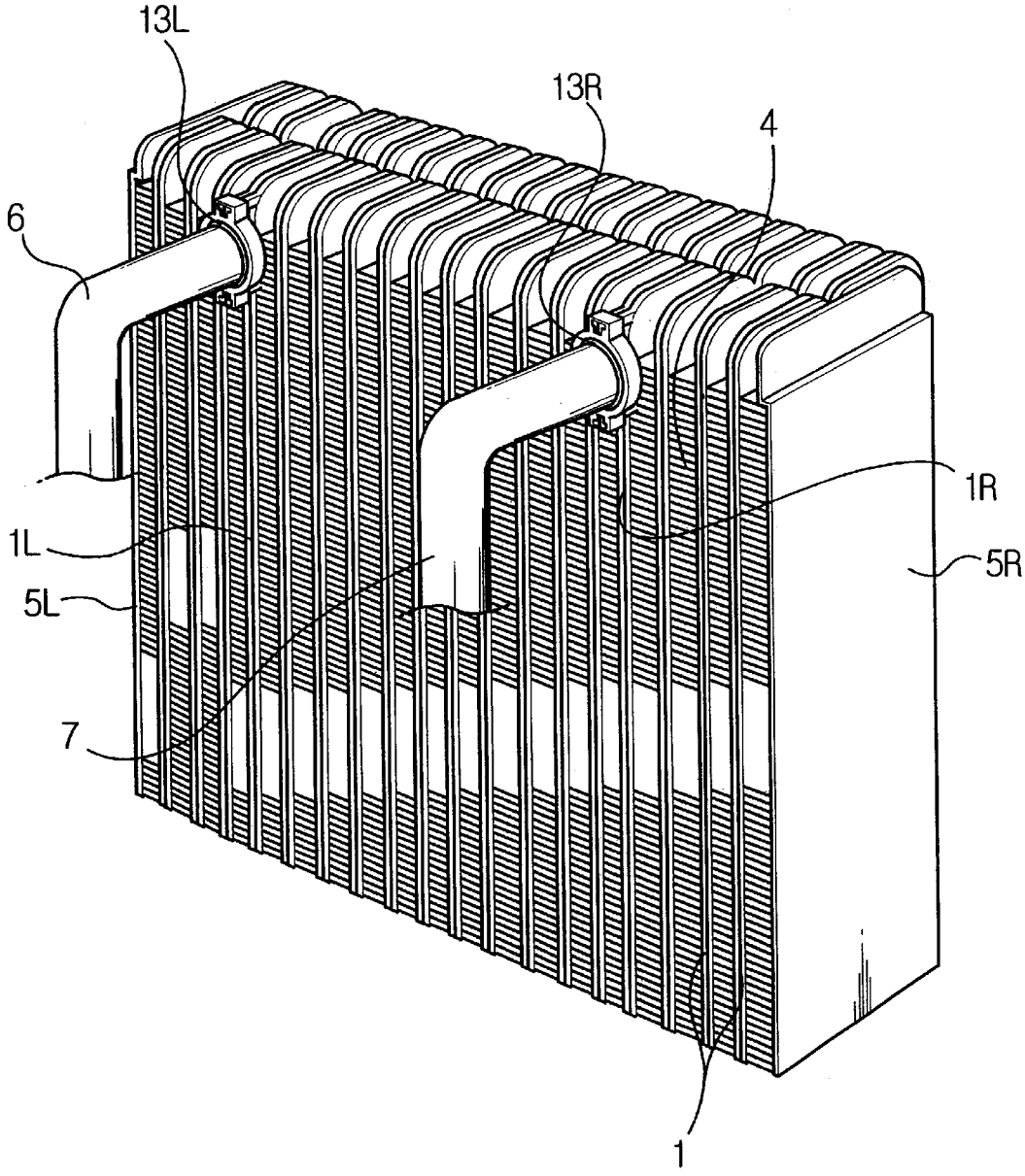
FIG. 2 is a perspective view showing the heat exchanger in accordance with the present invention.

As illustrated in FIGS. 1 and 2, a heat exchanger of the present invention includes a plurality of flat tubes 1 of aluminum alloy. Each of the flat tubes 1 is formed by brazing of plates 2 (refer to FIG. 3) into a single body. Although the flat tube 1 may have a pair of pockets 11A, 11B on its upper or lower end portion, or may have two pairs of pockets respectively on its upper and lower ends, only the flat tube 1 having a pair of pockets 11A, 11B on its upper end portion is illustrated and described in this specification since the remaining construction excepting the number of the pockets 11 is the same.

A plurality of fins 4 are positioned between each neighboring flat tubes 1. Two end plates 5L, 5R are respectively situated on both side ends of the heat exchanger and reinforce the structure of the heat exchanger. As described above, each flat tube 1 is formed by brazing two plates together. Among the flat tubes 1, there are two flat tubes 1 each having a cylindrical manifold portion 13L, 13R, which are connected to a refrigerant inflow pipe 6 connectable to an expansion valve(not shown), or to a refrigerant outflow pipe 7 connectable to a compressor(not shown). These two flat tubes are designated by the reference numerals 1L, 1R, being different from other common flat tubes 1, and are called manifold tubes. The plates constituting the manifold tubes 1L, 1R are designated by the reference numeral 2L, 2R, being different from remaining common plates 2, and are called cylindrical manifold plates.

Figure 3:
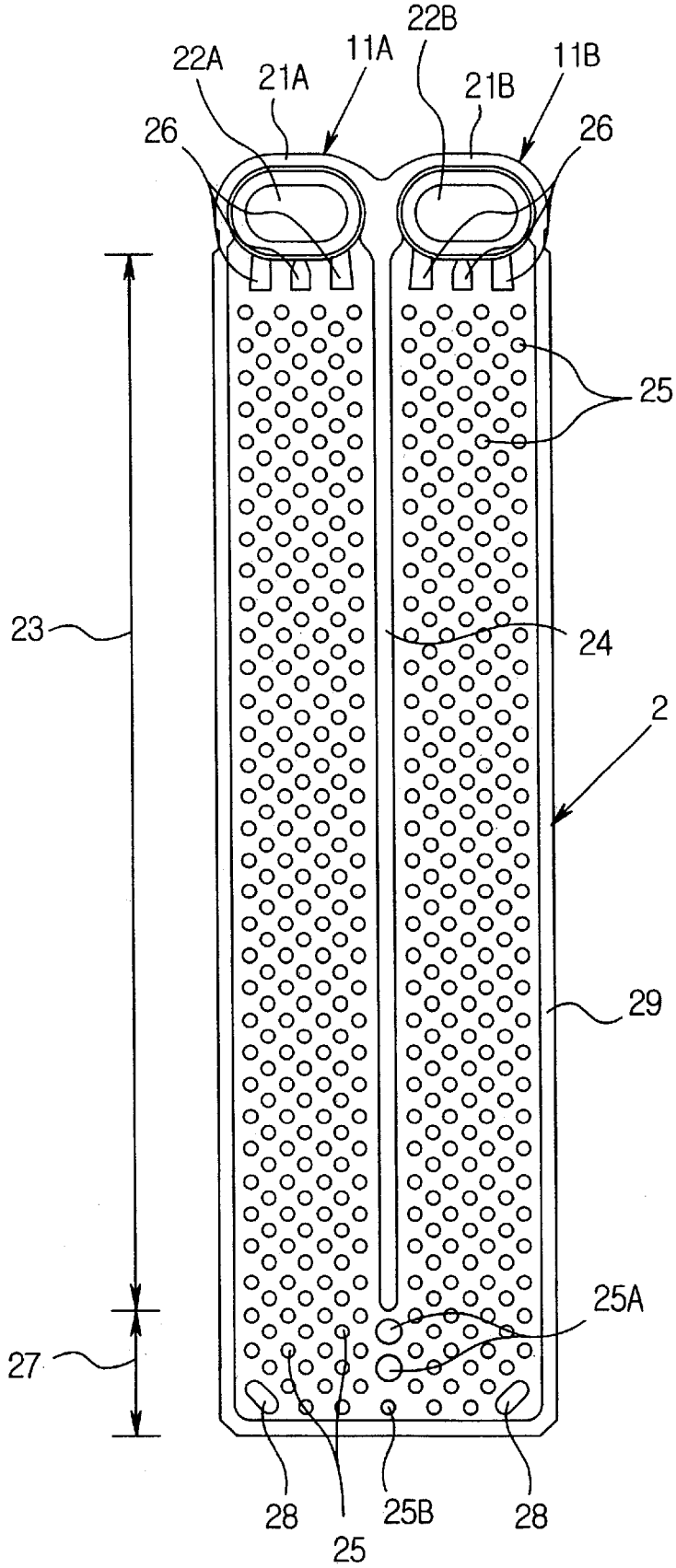
FIG. 3 is a front view showing a heat exchange plate in accordance with the present invention.

Each of the common plates 2 constituting the common flat tubes 1, as indicated in FIG. 3, has a pair of cup portions 21A, 21B on its upper end portion. Two slots 22A, 22B are respectively formed in the cup portions 21A, 21B respectively. Accordingly, when the two plates 2 are brazed together, two pairs of the cup portions 21A, 21B form a pair of pocket 11A, 11B. When a plurality of plates 2 are stacked side by side, the pockets communicate in a row through the slots 22.

A longitudinal partition protrusion 24 is formed along the longitudinal center line of the plate 2. A heat exchange portion 23 from which a plurality of small, round protrusions 25 are projected is formed beside the longitudinal partition protrusion 24. The longitudinal partition protrusion 24 is not extended to the bottom end of the plate 2, but is terminated at a position spaced apart from the bottom end of the plate 2. For example, the longitudinal partition protrusion 24 is terminated at a position spaced apart from the bottom end of the plate 2 by ⅛ of the length of the plate 2. Accordingly, a U-turn portion 27 is formed on the lower portion of the plate 2 to cause refrigerant to make a U-turn around the lower end of the longitudinal partition protrusion 24. A plurality of small, round protrusions 25 are also formed on the U-turn portion in the same arrangement as that of the above-described small, round protrusions 25.

The small, round protrusions 25 are inwardly projected from the plate 2 through an embossing process in a simple manner. Each of the small, round protrusions 25 has a circular or elliptical shape. The small, round protrusions 25 are preferably arranged in the pattern of a diagonal lattice so as to improve the flowablity of refrigerant and generate the turbulent flow of refrigerant. A flange 29 having the same height as that of the small, round protrusions 25 is preferably formed along the edge of the plate 2. As a result, when a pair of plates 2 are brazed into a single body, a flat tube 1 is formed, with the flange 29, the small, round protrusions 25 and the longitudinal partition protrusion 24 of one plate 2 being brought into contact with and brazed on the flange 29, the small, round protrusions 25 and the longitudinal partition protrusion 24 of the other plate 2, respectively. The flat tube 1, as a whole, has a U-shaped refrigerant passage, which is comprised of one pocket 11A, one half of the heat exchange portion 23 (a front-side passage), a U-turn portion 27 and the other half of the heat exchange portion 23 (a rear-side passage), and the other pocket 11B. In such a case, the longitudinal partition protrusion 24 functions as a partition wall, thus forming a U-shaped refrigerant passage as a whole. The longitudinal partition protrusion 24 and the small, round protrusions 25 additionally serve to enhance the mechanical strength of the plate 2 or tube 1.

Figure 4:
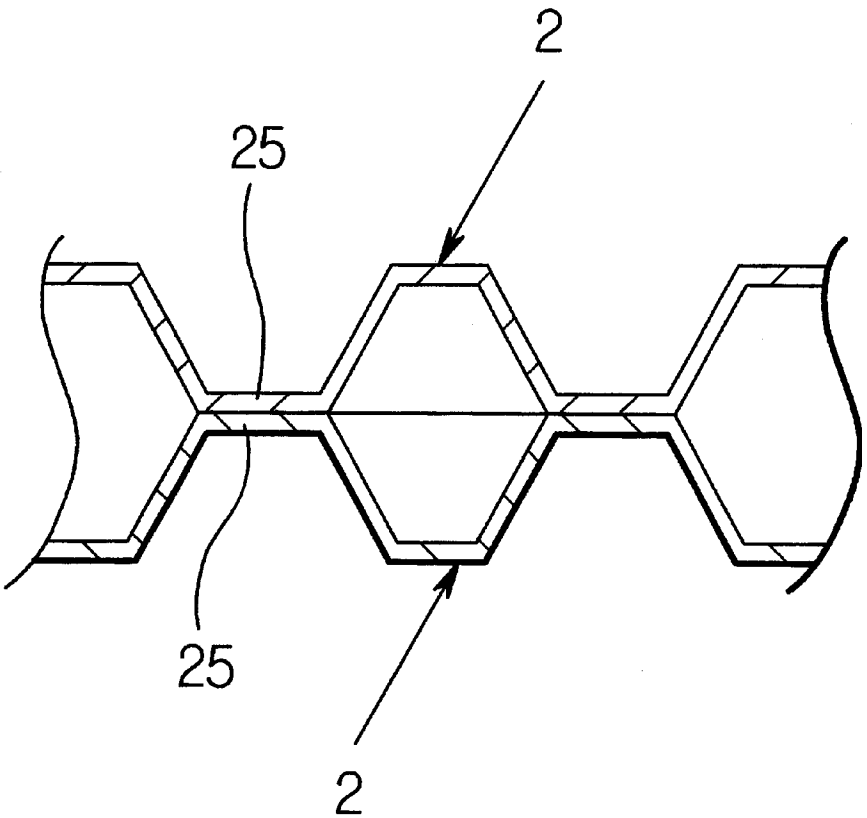
FIG. 4 is a detailed cross-section of a heat exchange flat tube in accordance with the present invention.
Figure 5:
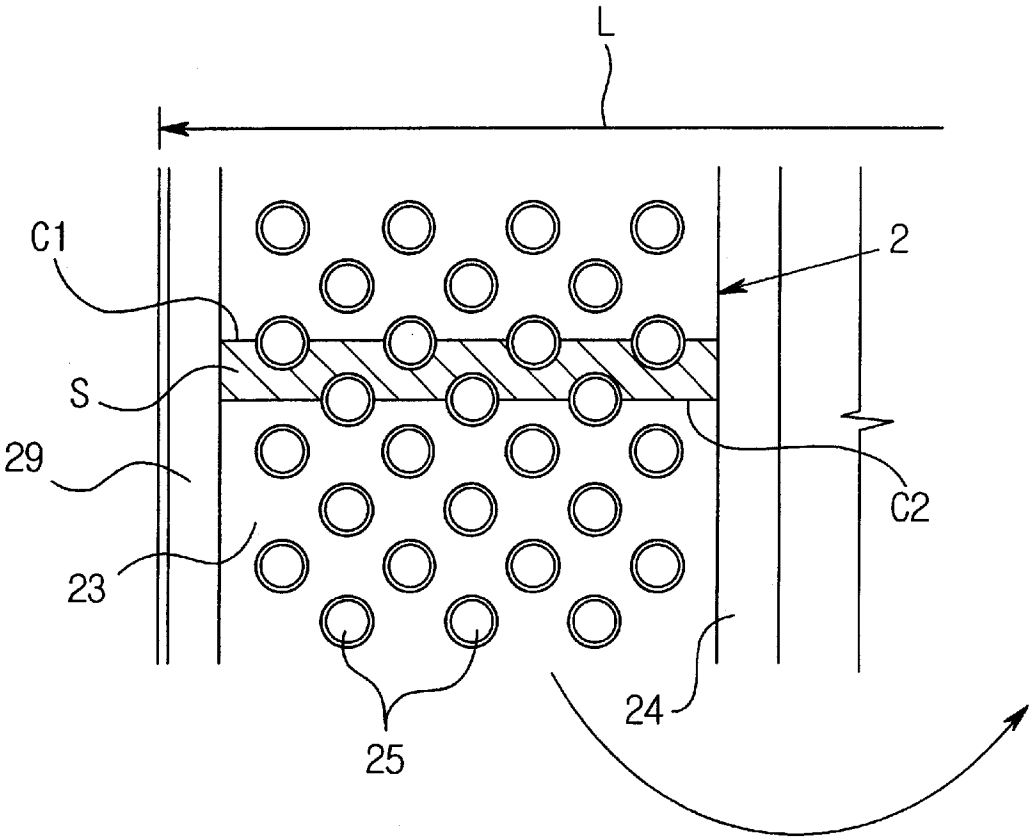
FIG. 5 is a detailed front view showing the inlet-side heat exchange portion of the heat exchange plate.

In order to firmly attach two plates 2 to each other with each of the small, round protrusions 25 of one plate 2 attached to each of the small, round protrusion 25 of the other plate 2, the end portions of the small, round protrusions 25 are preferably flat, as shown in FIG. 4. Although not illustrated in the drawings, the small, round protrusions 25 of one plate 2 each may have a hole or indent, the small, round protrusions 25 of the other plate 2 each may be inserted into the hole or indent, and each small, round protrusion 25 of one plate 2 and the corresponding small, round protrusion 25 of the other plate 2 are brazed together. Refrigerant flows through the refrigerant passages that are defined among the small, round protrusions 25 attached together. Since the small, round protrusions 25 are arranged in the pattern of a diagonal lattice, the refrigerant forms a turbulent flow while the refrigerant passes the small, round protrusions 25 attached together.

In order to enhance the strength of the attachment of two plates 2 in the U-turn portion 27 by reason that the flow pressure of the refrigerant is increased in the U-turn portion 27 due to change in the flow direction of the refrigerant, a plurality of reinforcing round protrusions 25A, 25B(for example, three in this embodiment) are formed along the lower, imaginary prolongation line of the longitudinal partition protrusion 24 while being arranged together with the other small, round protrusions 25 in the pattern of a diagonal lattice. Of the three reinforcing round protrusions 25A, 25B, two upper reforcing round protrusions 25A in the vicinity of the lower end of the longitudinal partition protrusion 24 are preferably larger than the other reinforcing one 25B (25A>25B), while the remaining protrusion 25B preferably is sized the same as the above-described small, round common protrusions 25. Two diagonal protrusions 28 are respectively formed on both corners of the U-turn portion 27 so as to reduce flow resistance against the refrigerant and pressure of the refrigerant, guide the refrigerant effectively in the U-turn portion 27 and further enhance the strength of the attachment of the two plate 2 in the U-turn portion 27.

Figure 7:
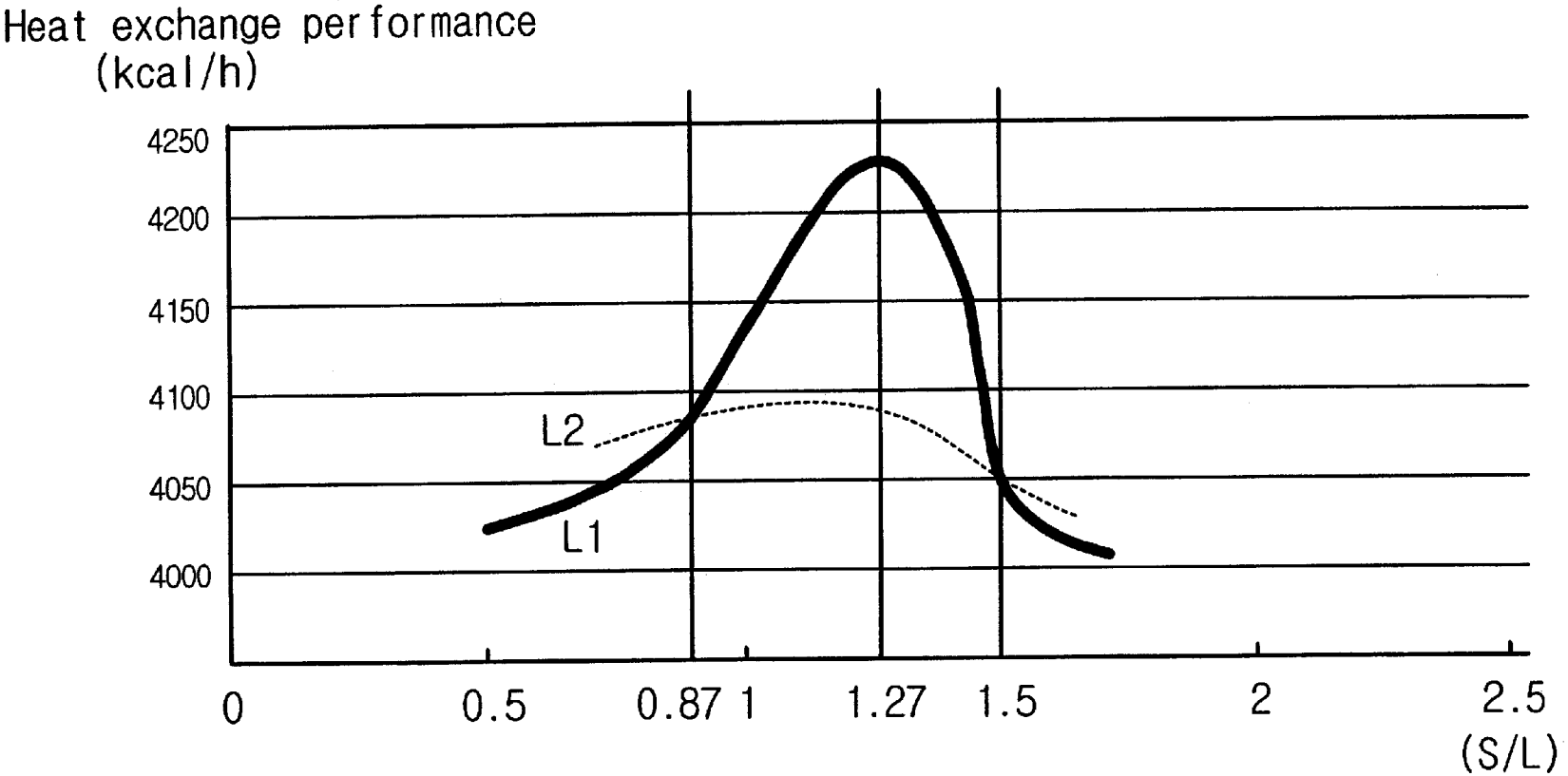
FIG. 7 is a graph in which the performances of heat exchange are plotted with regard to the ratio of the area of the rectangle (which is defined by the longitudinal partition protrusion, the flange and two center lines passing through two neighboring small, round protrusion rows) to the width of the heat exchange plate.
Figure 8:
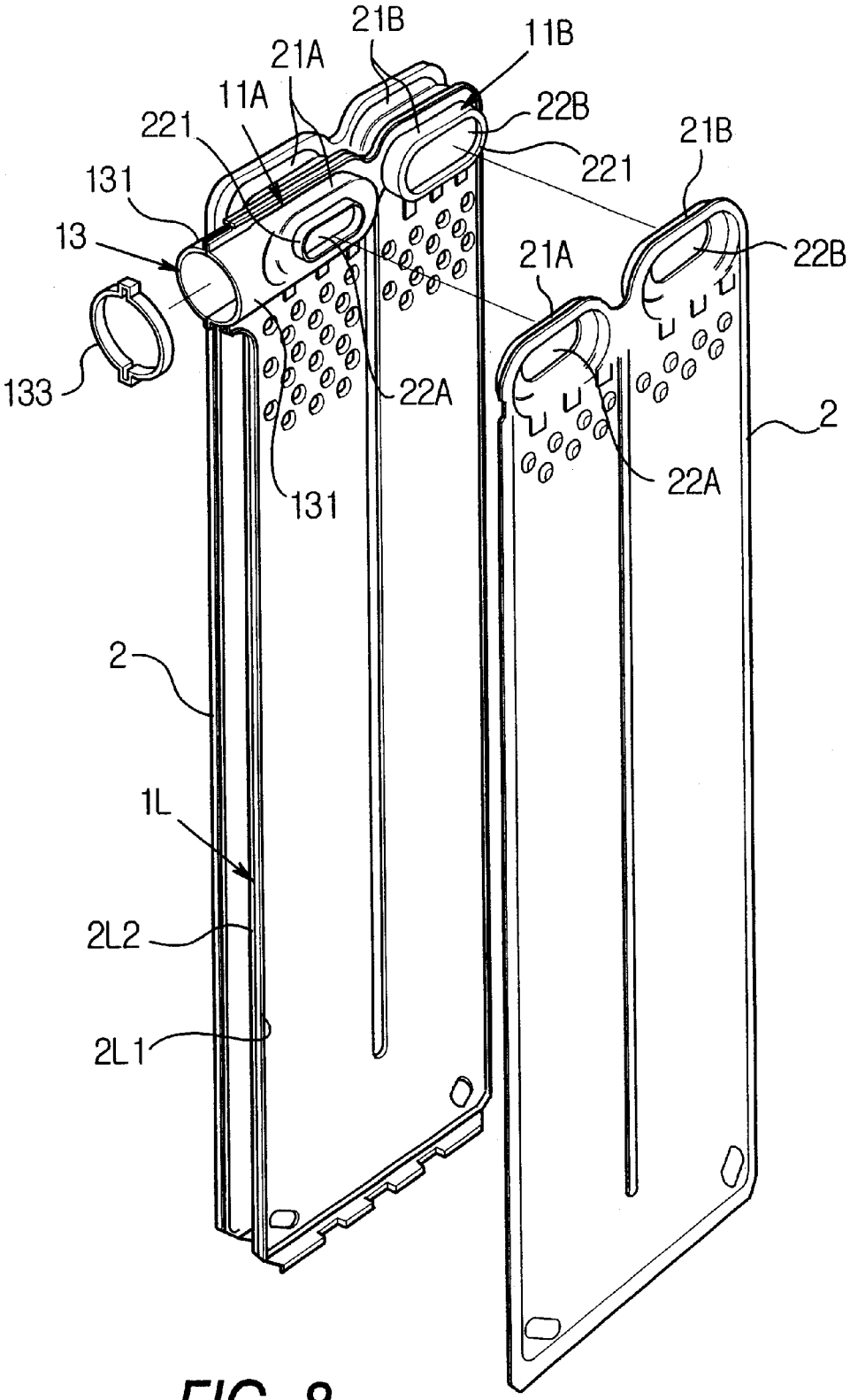
FIG. 8 is an exploded perspective view showing the attachment of the heat exchange plates.
Figure 9:
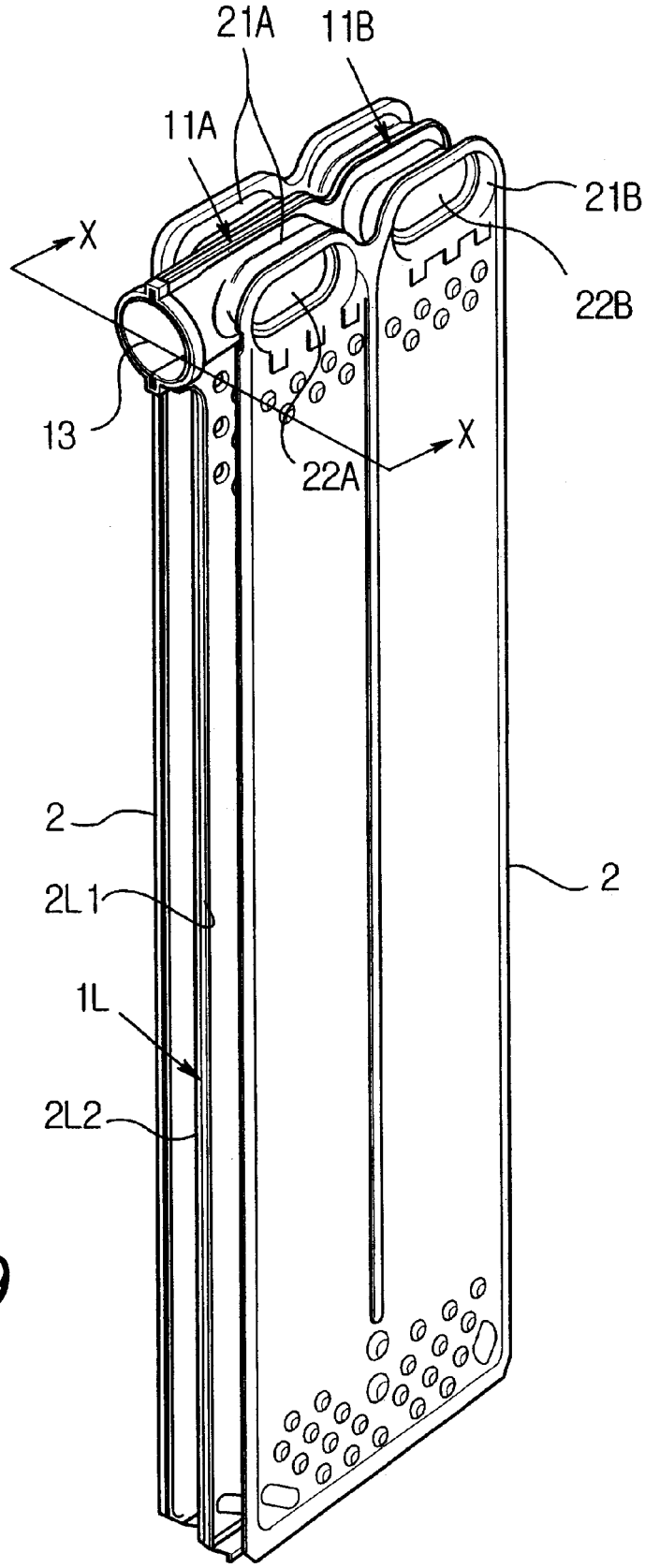
FIG. 9 is an assembled perspective view showing the attachment of the heat exchange plates.

The optimum efficiency of heat exchange can be achieved by optimizing the ratio S/L of the area S of the rectangle (which is defined by the longitudinal partition protrusion 24, the flange 29 and the two horizontal center lines C1 and C2 passing through two neighboring small, round protrusion rows) to the width L of the plate 2. The rectangle is defined by the longitudinal partition protrusion 24, the flange 29, the center line C1 of a first small, round protrusion row and the center line C2 of a second small, round protrusion row just over or just under the first row. A fact that the optimum efficiency of heat exchange is achieved by optimizing the ratio of the area S to the width L of the plate 2 is proved through various experiments. If the area S is 76.2 $mm^2$ and the width L of the plate 2 is 60 mm, the ratio S/L is 1.27 mm. Experiments show that this ratio brings about the optimum efficiency of heat exchange. As indicated in the graph of FIG. 7, when 0.89 mm$\leqq$S/L$\leqq$1.5 mm, the satisfactory efficiency of heat exchange can be achieved over conventional heat exchanger which has the substantially same structure with that of the present invention in light of the width of plate, number of tube row etc. In this graph, line L1 designates the heat exchange performance of the present invention and line L2 designates that of conventional one. The optimum ratio was determined without regard to external surroundings or conditions. Accordingly, the optimum ratio can be changed depending on the temperature of the air, the performance of the refrigerating cycle and/or the like. If this situation is taken into account, the optimum ratio S/L is preferably selected in the range of 0.89 to 1.5 mm.

When the ratio S/L is less than 0.89 mm, the flow resistance against the refrigerant becomes greater and accordingly the internal pressure of the flat tube 1 is increased, thereby lowering the flowability of the refrigerant and accordingly deteriorating the efficiency of heat exchange. Consequently, the refrigerant is not evaporated completely, so that liquid refrigerant is supplied to a compressor and damages the compressor. On the other hand, when the ratio S/L is greater than 1.5 mm, the flowability of the refrigerant becomes better but the efficiency of heat exchange is decreased due to a reduction in the turbulent flow effect.

The following table 2 shows the comparison of performance between the heat exchanger of the present invention employing the plate 2 of the present invention and a conventional heat exchanger, which is performed using a calorimeter.

TABLE 2

| Ratio S/L | Top mounting Calorie (Kcal/h) | Top mounting Pressure Drop ($Kg/cm^2$) | Bottom mounting Calorie (Kcal/h) | Bottom mounting Pressure Drop ($Kg/cm^2$) |
|---|---|---|---|---|
| Embodiment (1.27 mm) | 4.238 | 0.40 | 4.056 | 0.37 |
| Comparative example (1.66 mm) | 4.049 | 0.33 | 3.715 | 0.27 |

In table 2, it is readily understood that the heat exchanger made of the plate having the ratio S/L of 1.27 mm has a superior performance to the heat exchanger made of the plate having the ratio S/L of 1.66 mm regardless of the position of the pocket.

The flowability of the refrigerant considerably affects the efficiency of heat exchange. That is, the flowability of the refrigerant affects the efficiency of heat exchange in the flat tube 1, particularly and considerably in the heat exchange portion 23 and the U-turn portions 27. Accordingly, the height of each small, round protrusion 25 and the volume of the flat tube 1 should be taken into account as variables for the optimization of the efficiency of heat exchange.

Meanwhile, although the width L of the plate 2 was described as 60 mm, the width L, through numeral experiments, turns out not limited to this but can range from 46 mm to 63 mm. The aspect of the invention is achieved by reducing the area S in the case of the plate having a relatively small width L and increasing the area S in the case of the plate having a relatively great width L.

Figure 6:
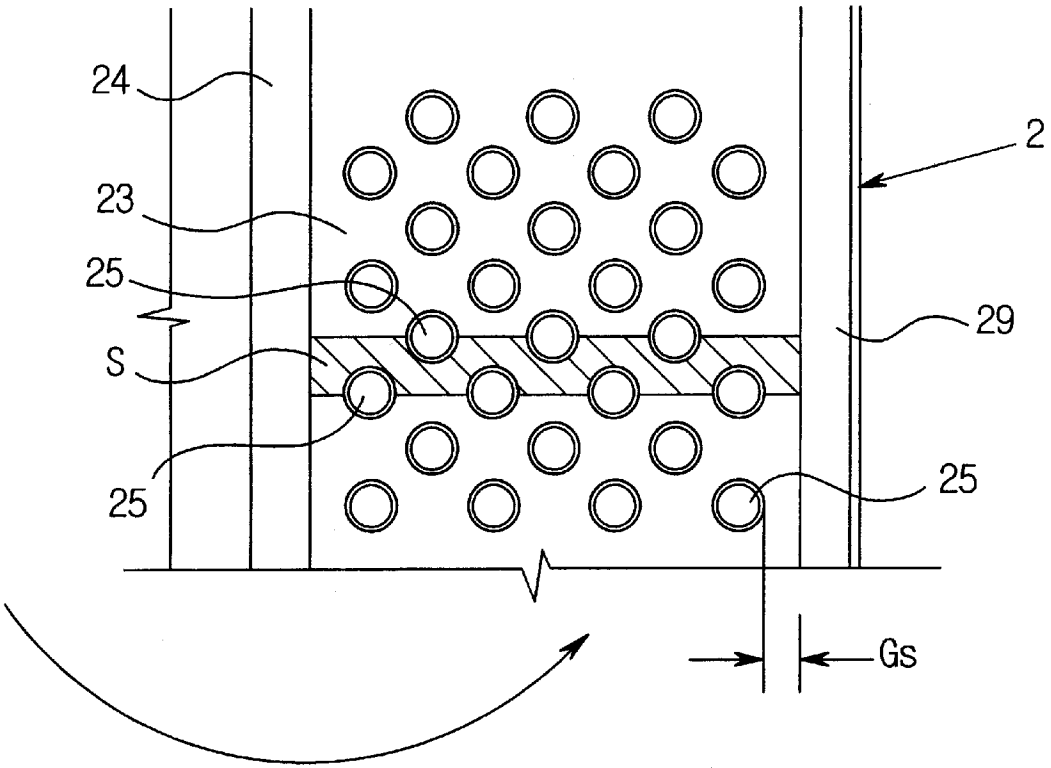
FIG. 6 is a detailed front view showing the outlet-side heat exchange portion of the heat exchange plate.

As illustrated in FIG. 6, since the flow direction of the refrigerant is changed while the refrigerant flows through the U-turn portion, the refrigerant is pushed toward the outlet-side flange portion 29 due to a centrifugal force and therefore is not distributed uniformly over the width of the heat exchange portion 23, resulting in a reduction in the efficiency of heat exchange. The phenomenon of the non-uniform flow distribution of the refrigerant is shown in FIGS. 22 to 25 that illustrate the non-uniform flow distribution of the refrigerant in the conventional heat exchanger.

In accordance with the present invention, in order to prevent the phenomenon of the non-uniform flow distribution of the refrigerant, the width Gs of the passage between the outlet-side flange portion 29 and the small, round protrusion 25 nearest to the outlet-side flange portion 29 is restricted to a certain range. This restriction prevents the non-uniform flow distribution of the refrigerant and uniformly distributes the refrigerant over the width of the heat exchange portion 23. The width Gs of the passage preferably ranges from 0.15 mm to 1.6 mm.

In the heat exchanger, refrigerant flows into the heat exchanger through the refrigerant inflow pipe 6, whereas the refrigerant flows out of the heat exchanger through refrigerant outflow pipe 7. As depicted in FIGS. 8 to 11, when refrigerant flows into the inlet-side front pocket 11A of the inlet-side manifold tube 1L through the refrigerant inflow pipe 6, the refrigerant flows into some of the neighboring pockets 11A of a first group(to which the inflow-side front pocket 11A of the inflow-side manifold tube 1L belongs) through both slots 22A of the pocket 11A of the inlet-side manifold tube 1L and moves into some of the pockets 11B of a second, opposite group(to which the inflow-side rear pocket 11B of the inflow-side manifold tube 1L belongs) through the U-shaped refrigerant passages in the flat tubes 1. When the refrigerant flows into some of the pockets 11B of the second group, the refrigerant flows into some of the pockets 11B of the third group(to which the outflow-side rear pocket 11B of the outflow-side manifold tube 1R belongs) through the slots 22B and moves into some of the pockets 11A of the fourth group (to which the outflow-side front pocket 11A of the outflow-side manifold tube 1R belongs)through the U-shaped refrigerant passages in the flat tubes 1. Finally, the refrigerant flows into the outflow-side pocket 11A of the outflow-side manifold tube 1R and is discharged into the compressor through the cylindrical manifold portion 13 and the refrigerant outflow pipe 7.

In the circulation of refrigerant, in the case of the conventional heat exchange, there occurs a phenomenon in which the flow rate of refrigerant supplied toward the end plate is less than the flow rate of refrigerant supplied toward the blank plate and accordingly the flow distribution of refrigerant is not uniform. The reason for this is that a burr portion is not formed on the slot of the inlet-side cup portion of the end plate-side plate of two plates 2 constituting the inlet-side manifold tube 1 L while a burr portion is formed on the slot of the inlet-side cup portion of the blank plate-side plate of two plates 2 constituting the inlet-side manifold tube 1L.

In the present invention, the uniform flow distribution of refrigerant can be achieved by improving the structure of the plate 2 that constitutes a part of the manifold tube 1L.

As shown in FIGS. 1, 2, and 8 to 11, the manifold tube 1L connected to the refrigerant inflow pipe 6 has the cylindrical manifold portion 13 that is extended from its one pocket 11A to the outside and communicates with the interior of the pocket 11A. This cylindrical manifold portion 13 is connected to the refrigerant inflow pipe 6, thereby allowing the refrigerant inflow pipe 6 to communicate with the manifold tube 1. The cylindrical manifold portion 13 is formed when a first manifold plate 2L1 and a second manifold plate 2L2 each having a semi-cylindrical manifold portion 131 are attached to each other.

Figure 10:
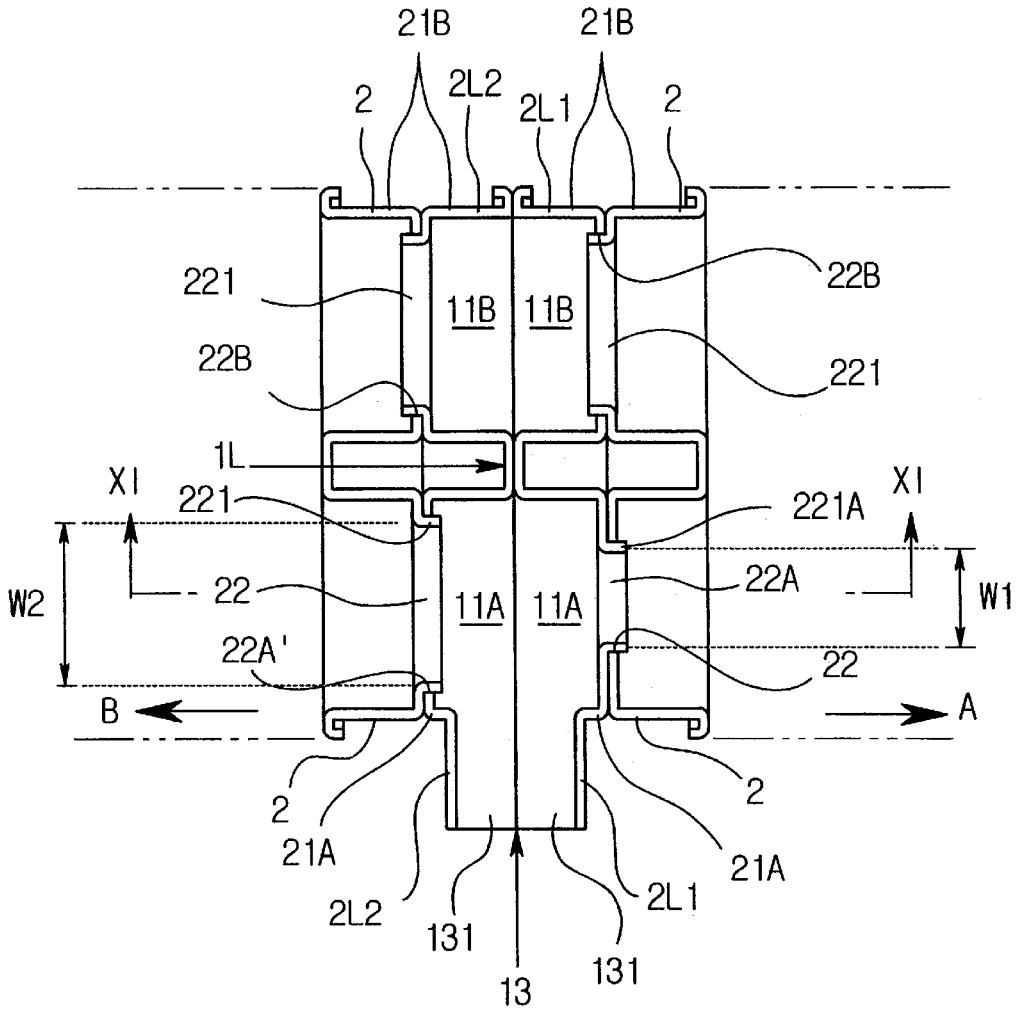
FIG. 10 is a horizontal cross-section view according to the line X—X of FIG. 9.
Figure 11:
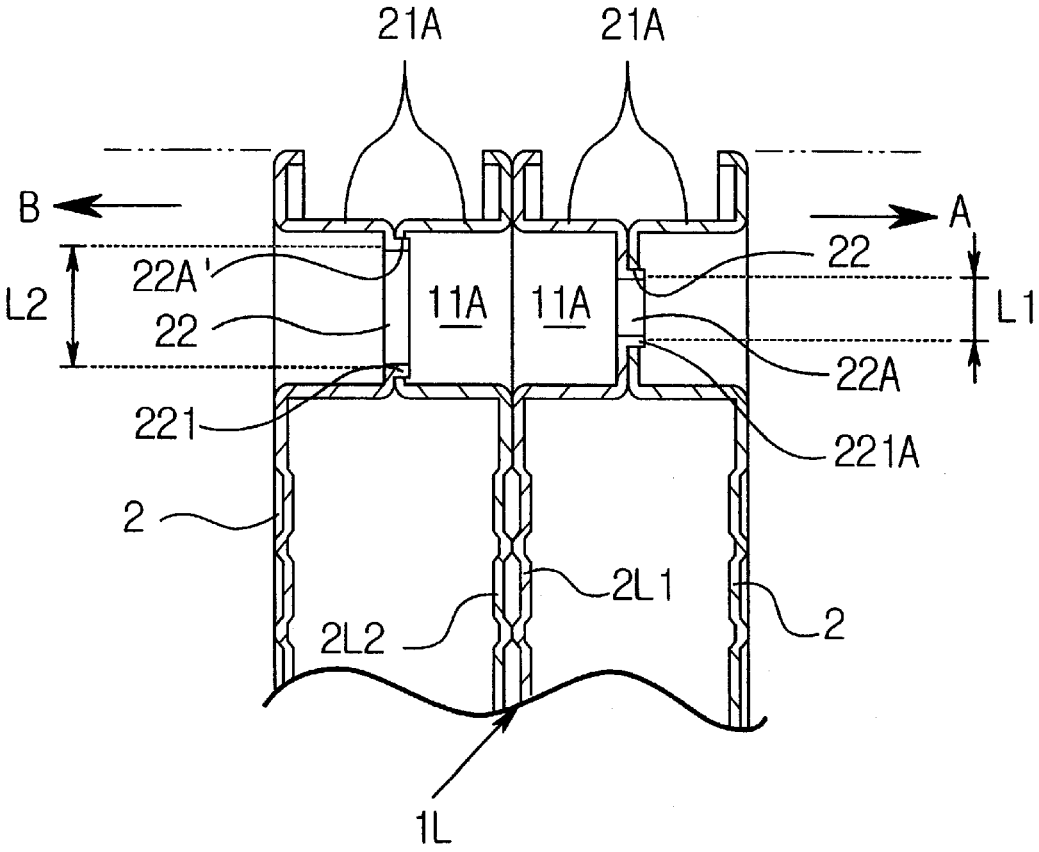
FIG. 11 is a vertical cross-section view according to the line XI—XI of FIG. 10.

As shown in FIG. 10, the first manifold plate 2L1 is defined as one facing the blank plate-side, whereas the second manifold plate 2L2 is defined as one facing the end plate-side.

The burr portion 221 is formed on the first manifold plate 2L1 to be extended from the edge of the first slot 22A of the first manifold plate 2L1 to the outside. The burr portion 221 is inserted into the slot 22 of the blank plate-side neighboring plate 2. While, the burr portion 221 is not formed on the second manifold plate 2L2, differently from the first manifold plate 2L1. The burr portion 221 extended from the edge of the slot 22 of the plate 2 of an end plate-side neighboring plate 2 is inserted into the second slot 22A' of the second manifold plate 2L2.

In accordance with the invention, the length L1 and width W1 of the first slot 22A and the corresponding length and width of the slot 22 of the blank plate-side neighboring plate 2 each are less than the length L2 and width W2 of the second slot 22. The second slot 22 preferably is 16.6 mm long and 10.8 mm wide, while the first slot 22A and the corresponding slot 22 of the blank plate-side neighboring plate 2 each are preferably 15 mm long and 9 mm wide.

When the size of the first slot 22A is less than the size of the second slot 22A', refrigerant flowing into the pocket 11A through the refrigerant inflow pipe 6 flows toward the end plate side through the second slot 22A' having a relatively large size and simultaneously flows toward the blank plate side through the first slot 22A having a relatively small size.

Figure 12:
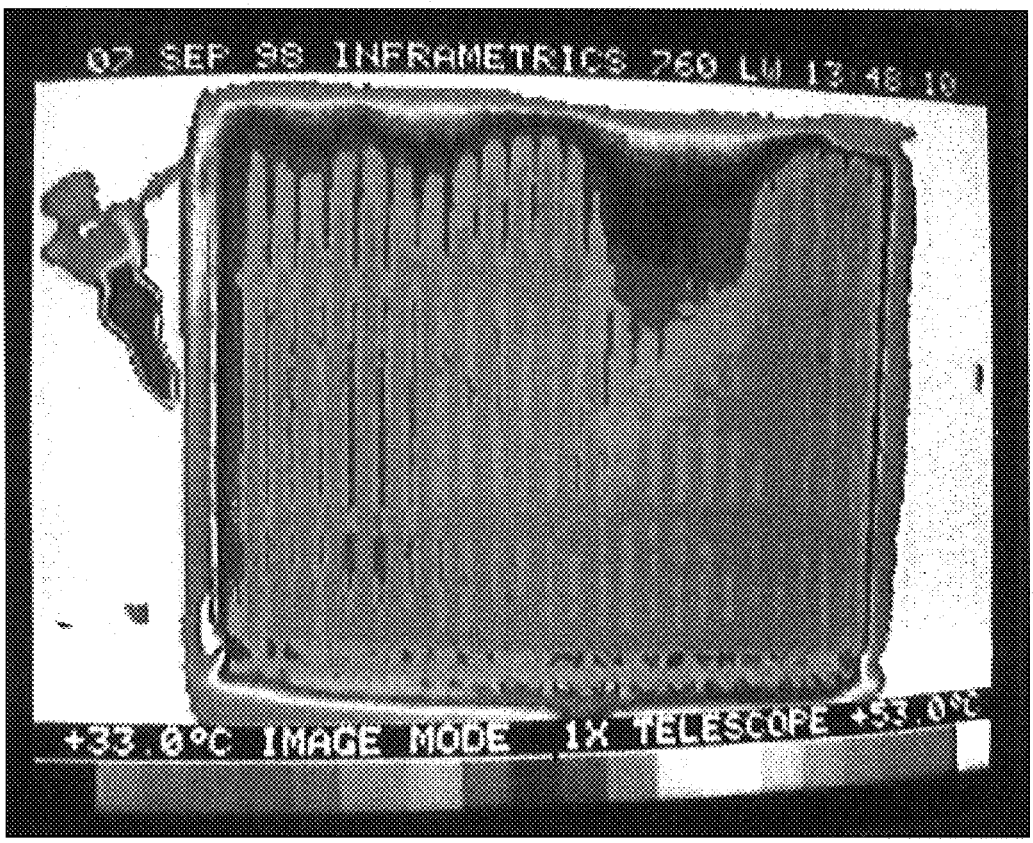
FIG. 12 is a photograph showing the flow distribution of the refrigerant in the 24-row type 3/8 to 7/4-pass evaporator of the invention installed in a bottom mounting fashion, which is taken using an infrared camera.
Figure 13:
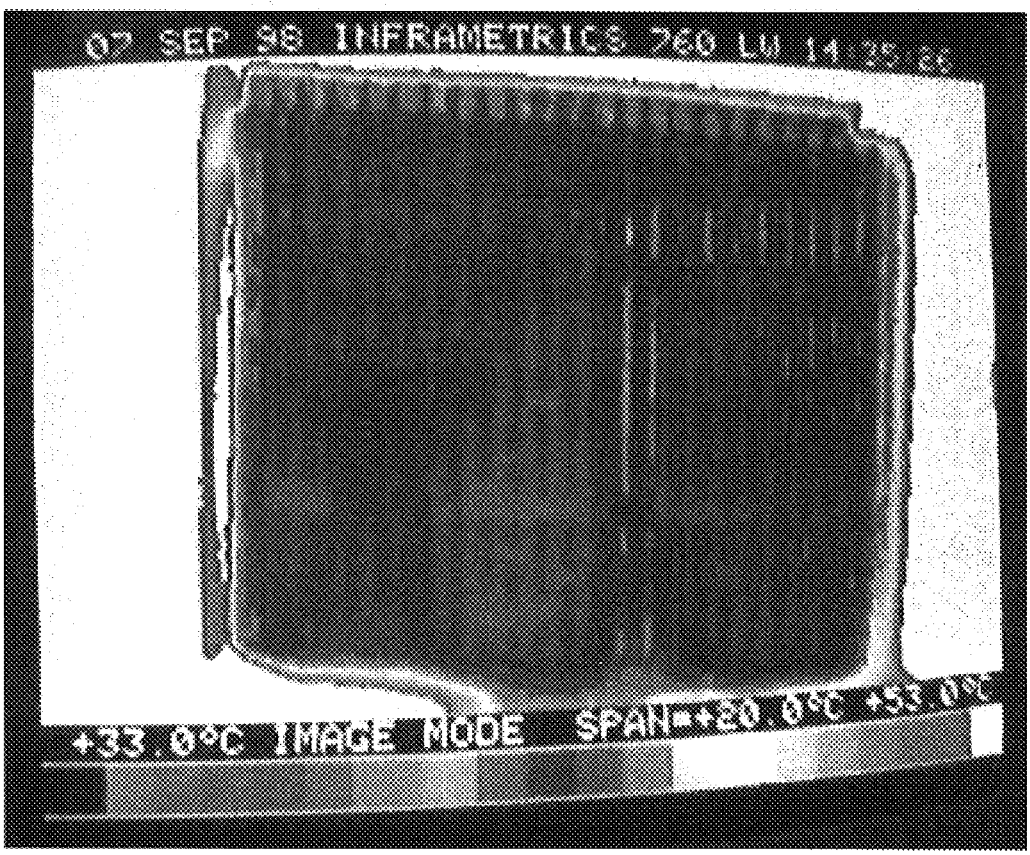
FIG. 13 is a photograph showing the flow distribution of the refrigerant in the 24-row type 3/8 to 7/4-pass evaporator of the invention installed in a top mounting fashion, which is taken using an infrared camera.

Accordingly, when only the sizes of the slots 22A, 22A' are taken into account, the flow rate of refrigerant passing through the second slot 22A' is greater than the flow rate of refrigerant passing through the first slot 22A. However, in practice, the flow of refrigerant passing through the second slot 22A' is resisted by the burr portion 221 that is extended from the edge of the slot 22 of the end plate-side neighboring plate 2 and inserted into the second slot 22A' of the second manifold plate 2L2, thereby reducing the flow rate of the refrigerant passing through the second slot 22A'. As a result, the flow rate of refrigerant flowing toward the end plate 5L is balanced by the flow rate of refrigerant flowing toward the blank plate, so that the entire flow distribution of refrigerant is made uniform. The flow distributions of refrigerant are not different for top and bottom mounting fashions. As shown in FIGS. 12 and 13, these flow distributions of refrigerant are confirmed by the photographs of temperature distributions, which are taken at a position 1 m away from the front of the 3/8–7/4-pass heat exchanger using an infrared camera while the heat exchanger is mounted in top and bottom mounting fashions.

If the uniform flow distribution can be achieved, it is not necessary for a burr portion to be formed along the edge of the inlet-side and blank plate-side slot 22A and it does not matter that the length and width of the inlet-side and blank plate-side slot 22A is less than the length and width of the end plate-side slot 22A'.

In the manifold tube 1L in which the manifold plates 2L1,2L2 having the above-described structure is employed, there is a concern that the flow distribution of the refrigerant flowing into the neighboring pockets 11A through the slots 22 is different from the flow distribution of the refrigerant flowing into the heat exchange portion 22. That is, there is a concern that a larger amount of refrigerant flows into the heat exchange portion 23.

Figure 14:
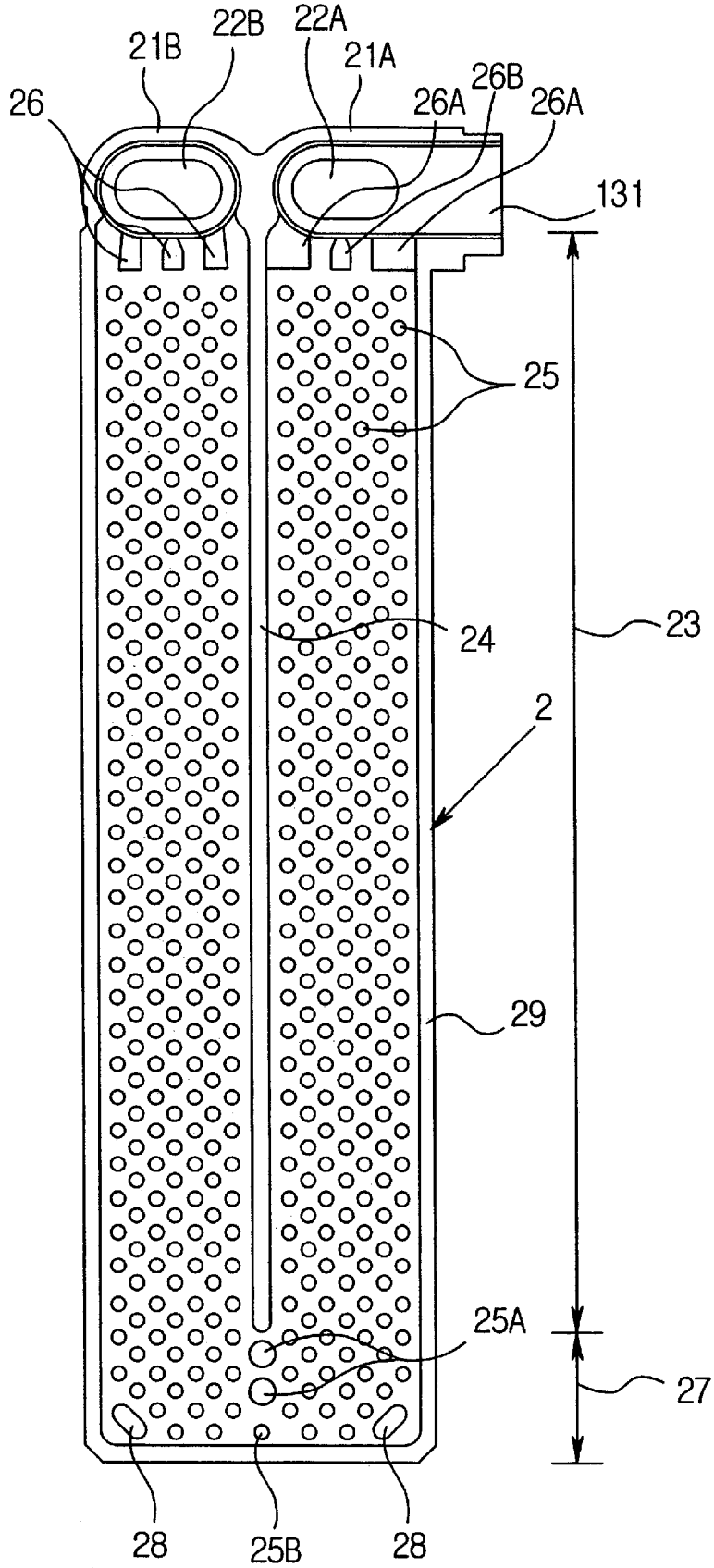
FIG. 14 is a front view showing another manifold plate in accordance with the present invention.
Figure 15:
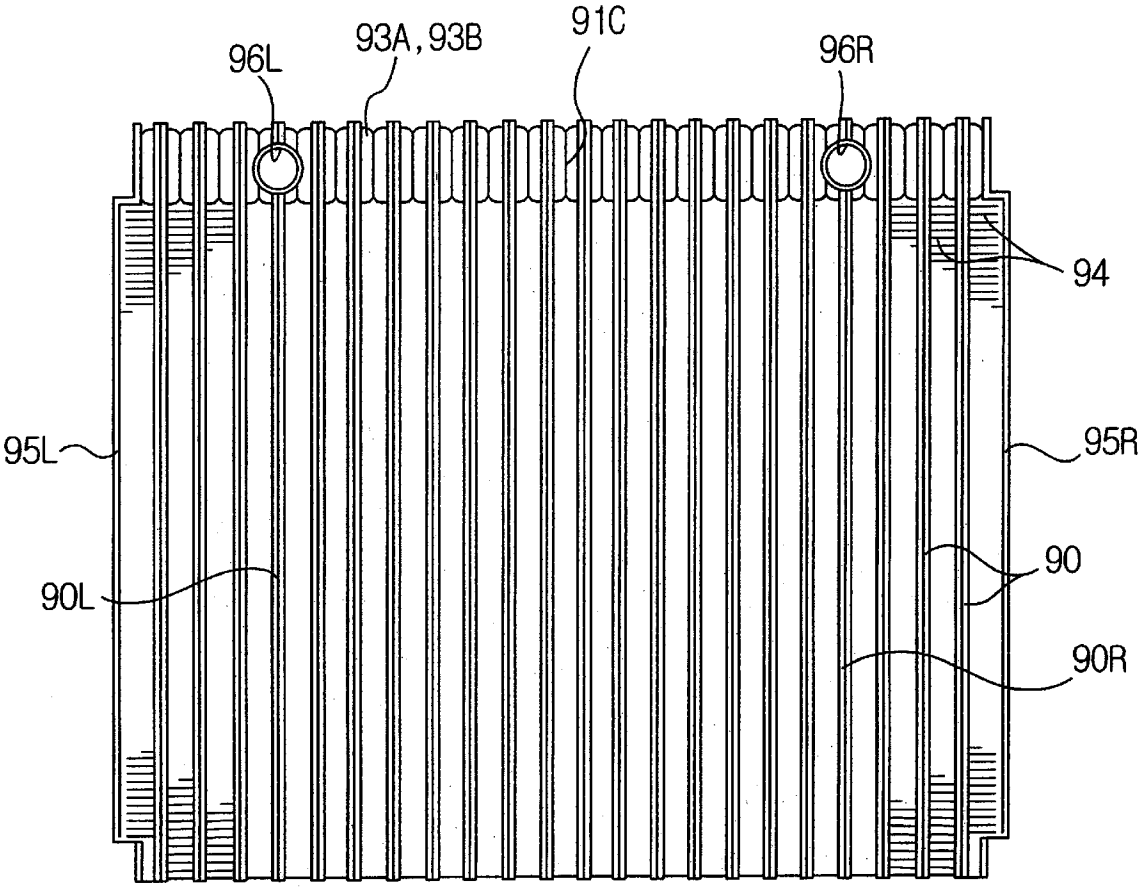
FIG. 15 PRIOR ART
FIG. 15 is a front view showing a conventional stack type heat exchanger.
Figure 16:
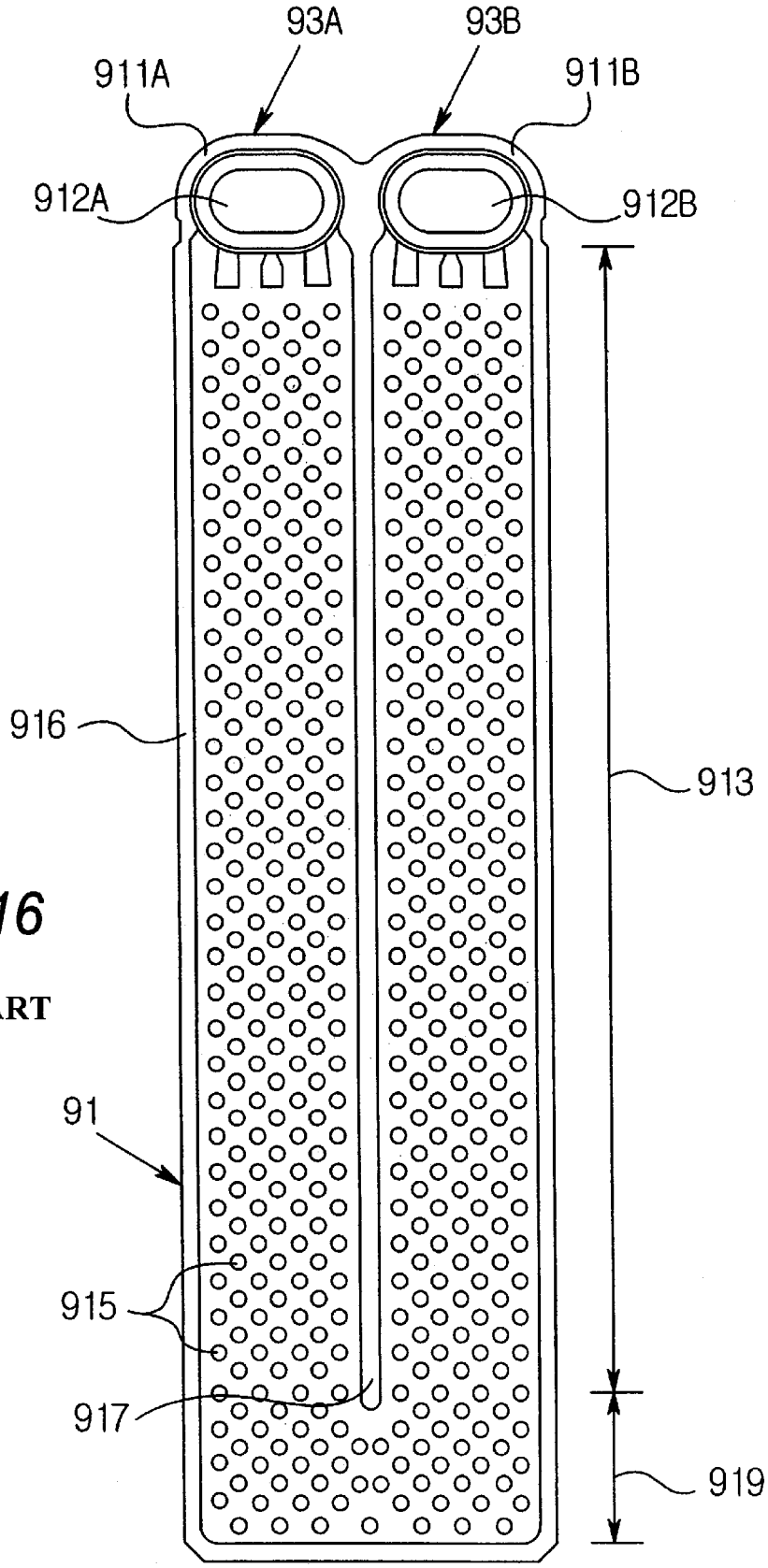
FIG. 16 PRIOR ART
FIG. 16 is a front view showing a conventional heat exchange plate.
Figure 17:
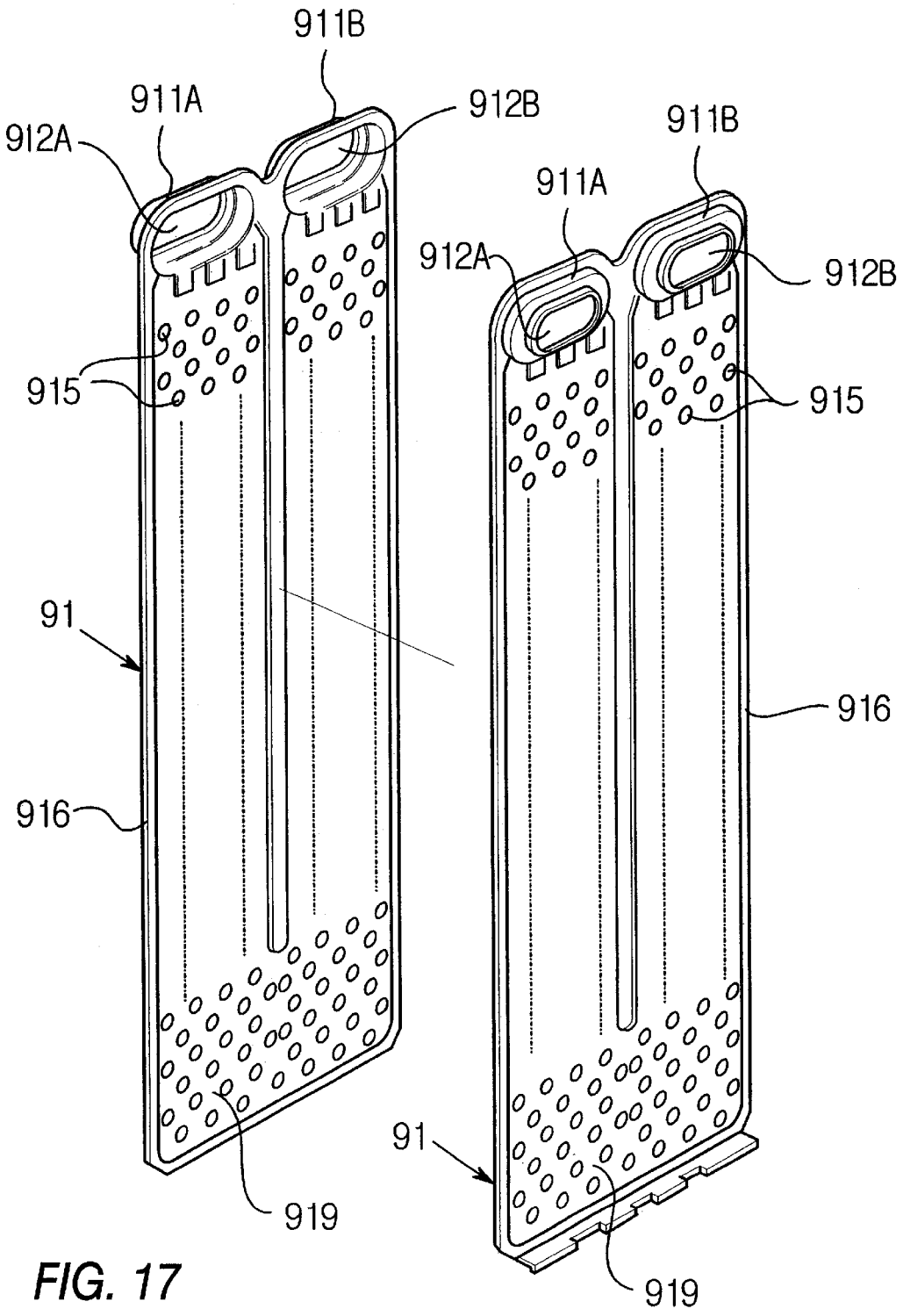
FIG. 17 PRIOR ART
FIG. 17 is an exploded perspective view showing a conventional heat exchange flat tube.
Figure 18:
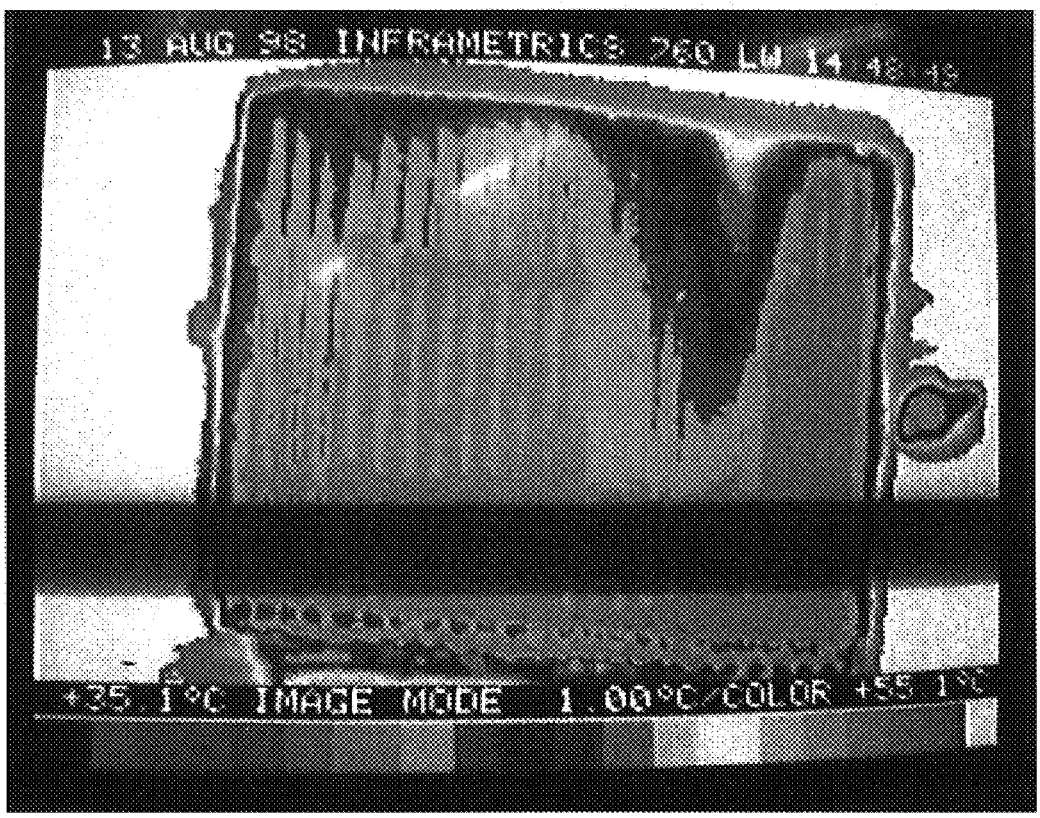
FIG. 18 is a photograph showing the flow distribution of the refrigerant in the 24-row type 4/7–7/4-pass evaporator of the conventional art installed in a bottom mounting fashion, which is taken using an infrared camera.
Figure 19:
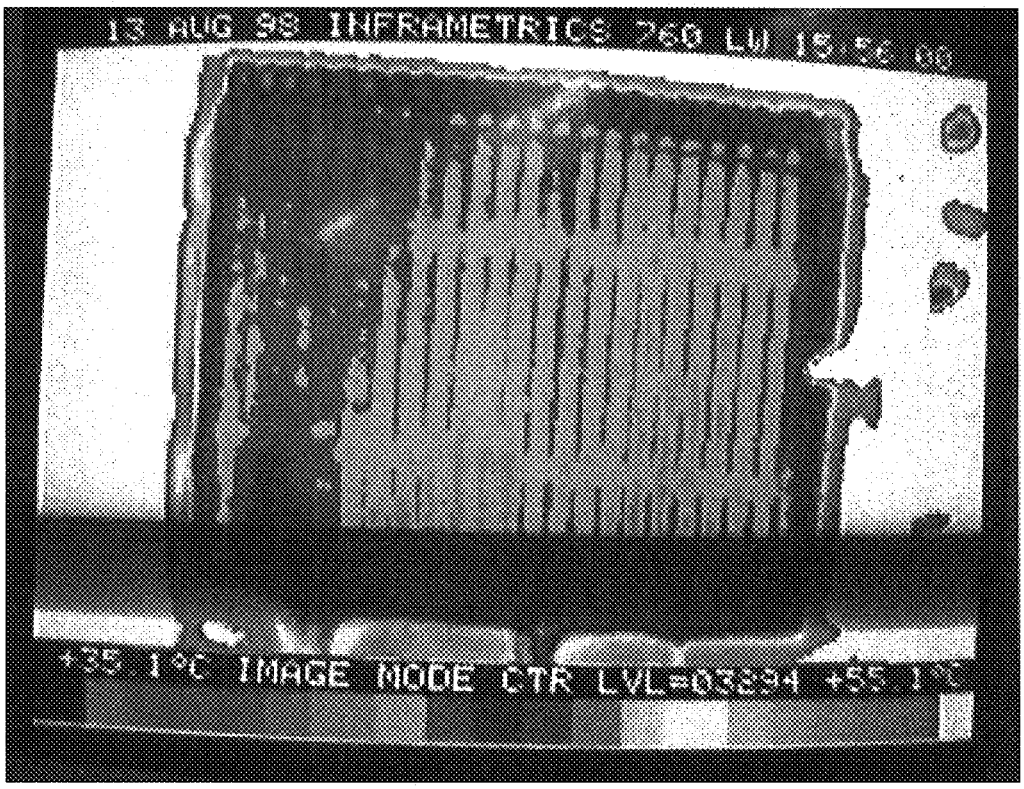
FIG. 19 is a photograph showing the flow distribution of the refrigerant in the 24-row type 4/7–7/4-pass evaporator of the conventional art installed in a top mounting fashion, which is taken using an infrared camera.
Figure 20:
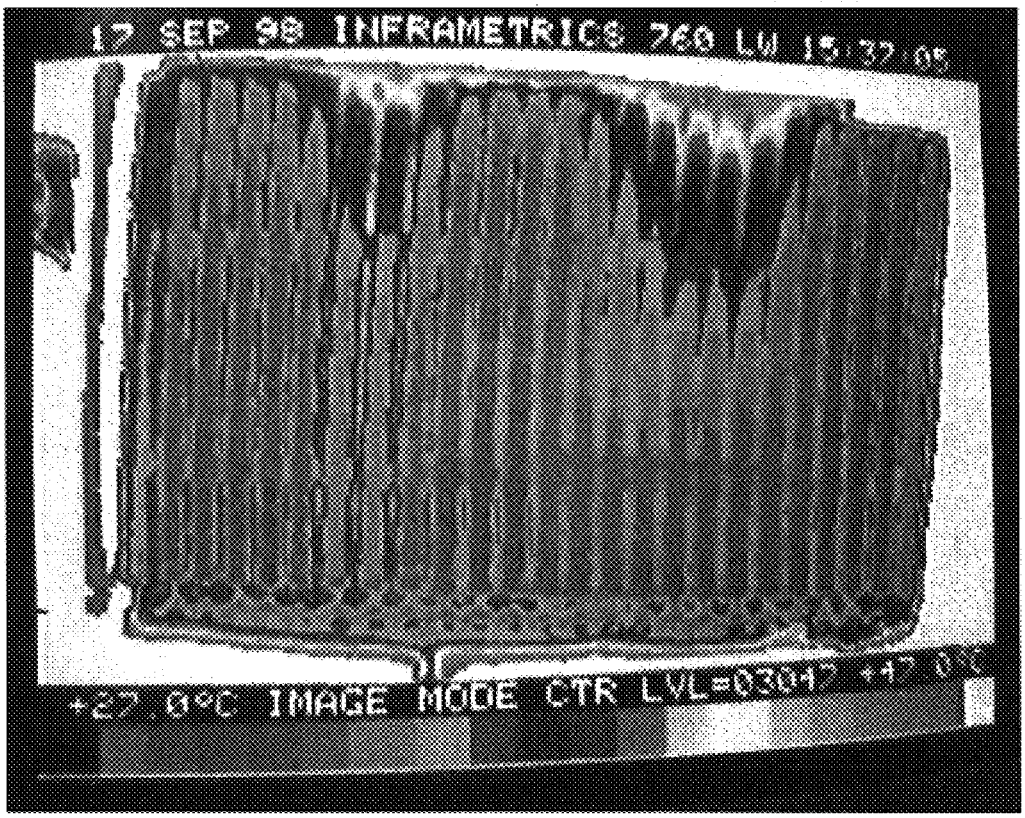
FIG. 20 is a photograph showing the flow distribution of the refrigerant in the 24-row type 3/8–7/4-pass evaporator of the conventional art installed in a bottom mounting fashion, which is taken using an infrared camera.
Figure 21:
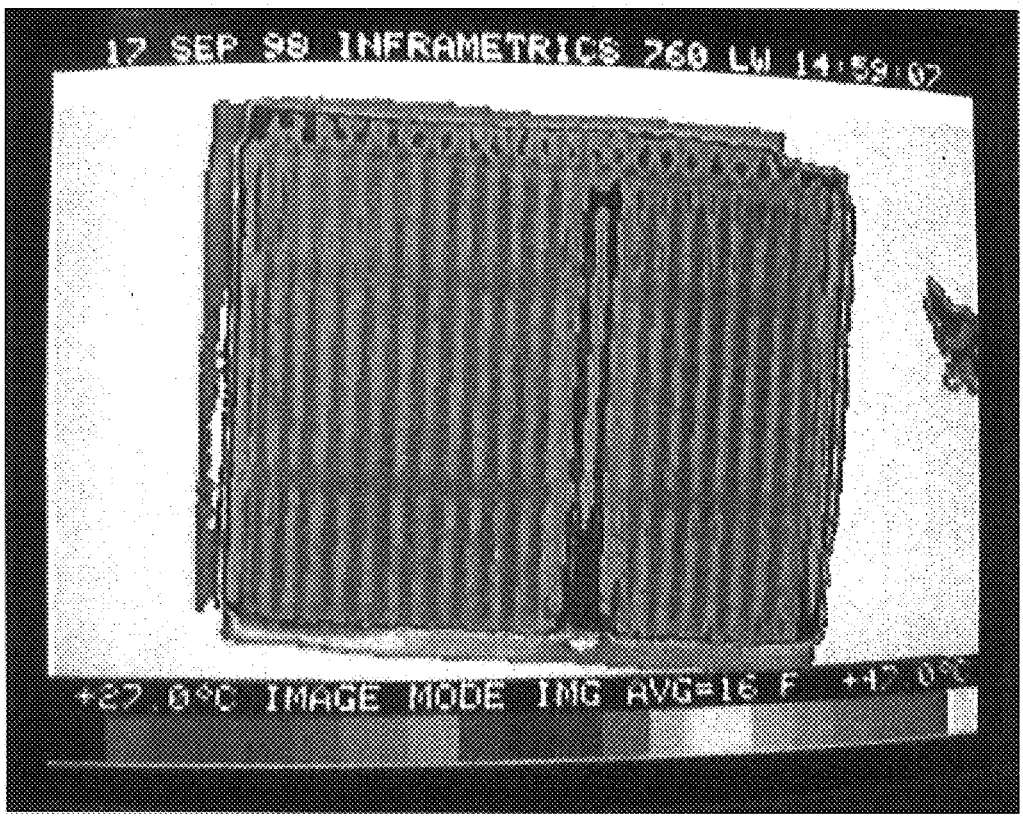
FIG. 21 is a photograph showing the flow distribution of the refrigerant in the 24-row type 3/8–7/4-pass evaporator of the conventional art installed in a top mounting fashion, which is taken using an infrared camera.
Figure 22:
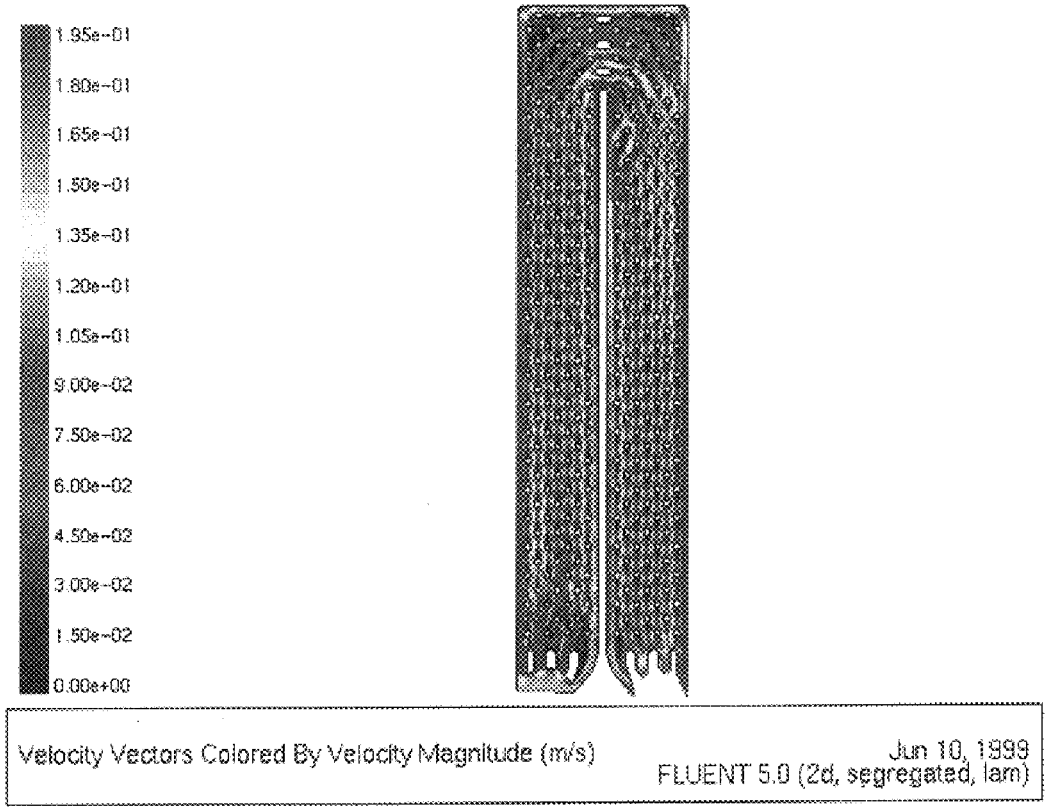
FIG. 22 is an enlarged view showing the flow distribution of the refrigerant in the heat exchange plate of the conventional art installed in a bottom mounting fashion, which is taken using an infrared camera.
Figure 23:
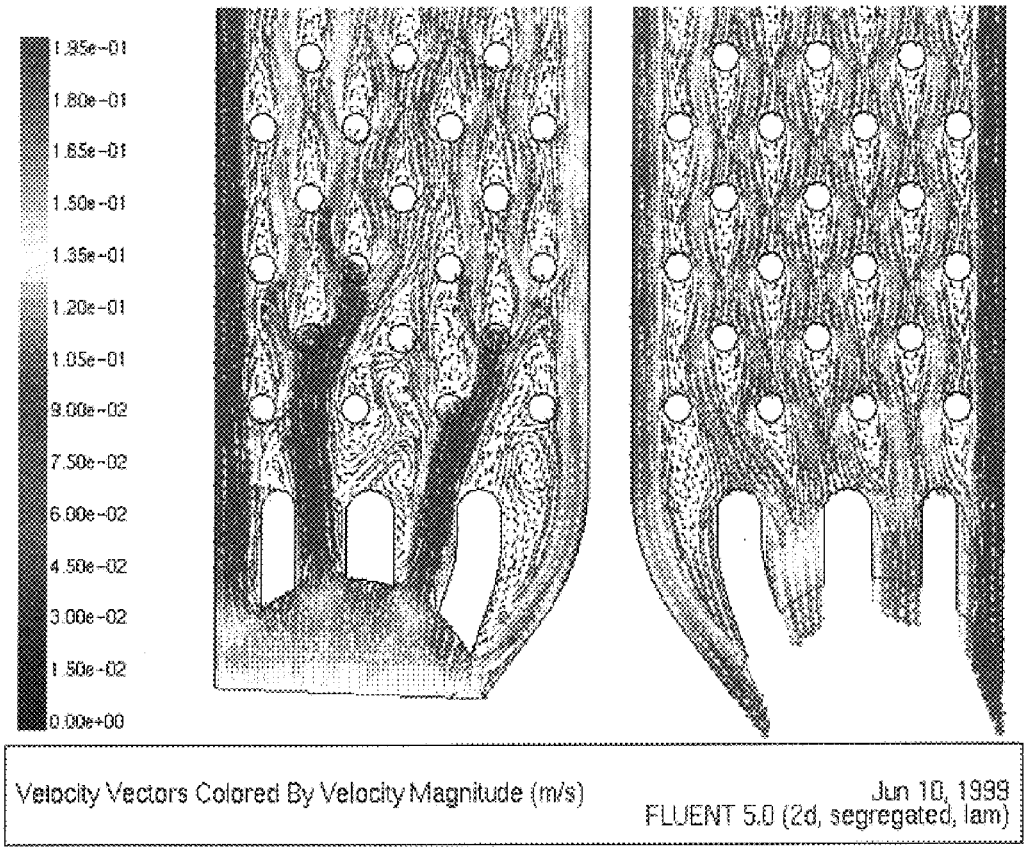
FIG. 23 is a further enlarged view showing the upper portion of the heat exchange portion of the heat exchange plate of FIG. 22.
Figure 24:
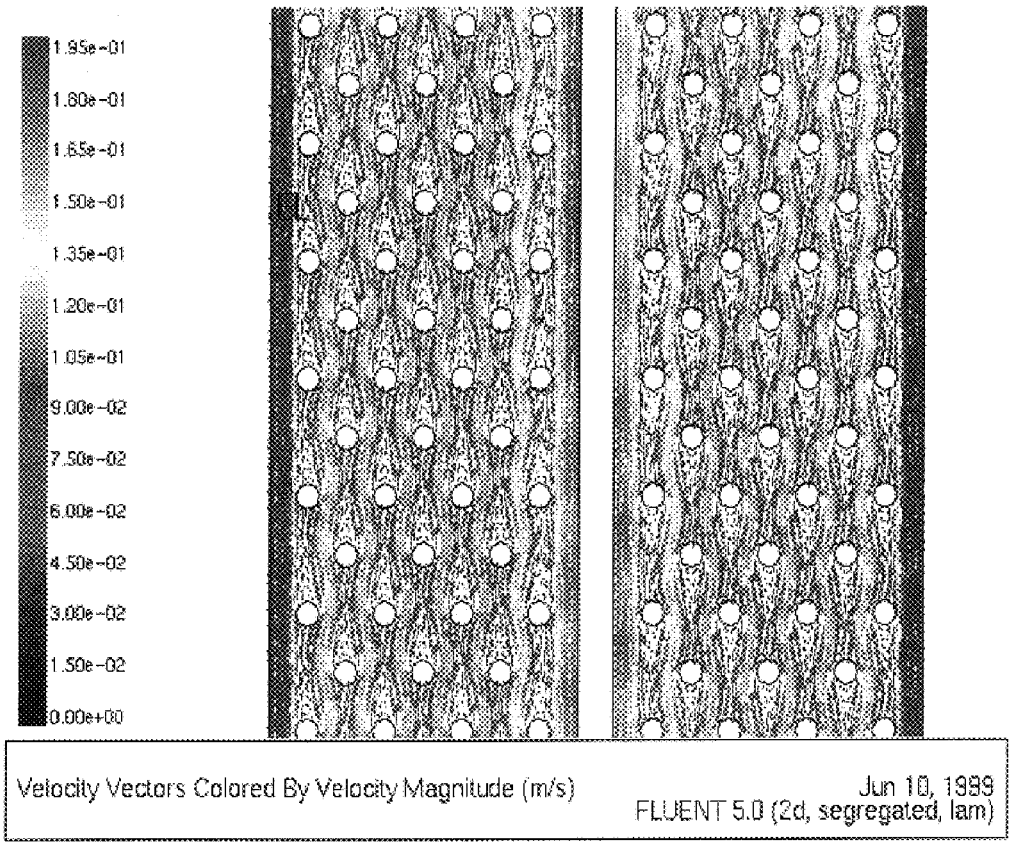
FIG. 24 is a further enlarged view showing the center portion of the heat exchange portion of FIG. 22.
Figure 25:
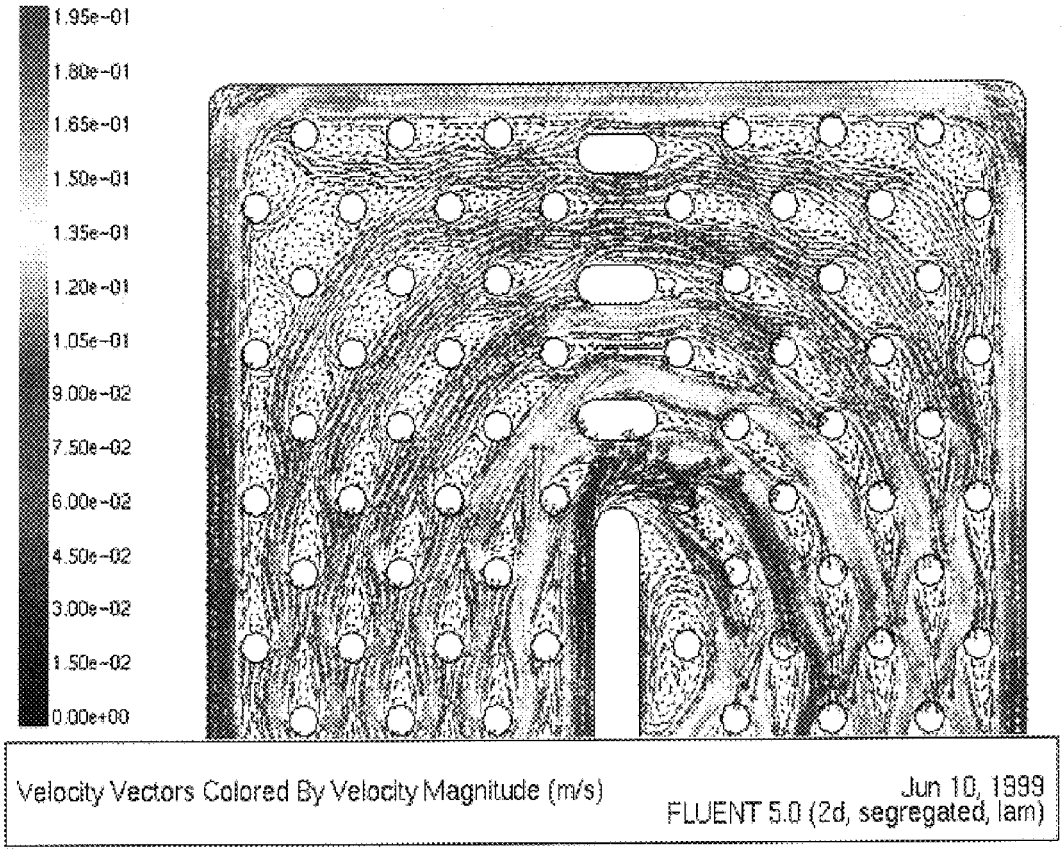
FIG. 25 is a further enlarged view showing the U-turn portion of FIG. 22.

As illustrated in FIG. 3, in the general plates 2 excepting the manifold plates 2L, for the purpose of guiding refrigerant from the pocket 11A into the heat exchange portion 23, three short vertical protrusions 26 are inwardly projected from the plate 2 at positions under the cup portion 21 side by side, thus forming refrigerant passages. In the present invention, as shown in FIG. 14, the uniform flow distribution of the refrigerant is achieved by changing the structure of three vertical protrusions 26 formed under the cup portion 21 connected to the semi-cylindrical manifold portion 131. That is, both side vertical protrusions 26A, 26A are respectively horizontally extended to the longitudinal partition protrusion 24 and to the neighboring portion of the flange 29, so that the flow distribution of the refrigerant flowing into the neighboring pockets 11A through the slots 22 and the flow distribution of the refrigerant flowing into the heat exchange portions 23 through the vertical passages formed by protrusions 26A, 26B, 26A are made uniform. Hence, the uniform flow distribution of the refrigerant is achieved over the entire heat exchanger, so that the performance of heat exchange is further improved.

From other aspect of the present invention, in order to remedy the weak structure of the connection portion between the manifold portion of manifold tube and refrigerant inflow pipe or outflow pipe, a spacer 133 is inserted around the manifold portion 13 of the manifold tubes 1L, 1R. The flat ring-shaped spacer 133 can compensate for thin thickness of the manifold portion and thus enhance the strength of the manifold portion 13 to resist the bending moment exerted thereon when the inflow pipe or outflow pipe is bent during mounting the heat exchanger to the vehicle body.

The effects of the plate and the heat exchanger of the present invention are as follows.

First, a plurality of small, round protrusions 25 are arranged on each heat exchange plate 2 so that the ratio S/L of the area S of the rectangle (which is defined by the longitudinal partition protrusion 24, the flange 29 and two center lines C1 and C2 passing through two neighboring small, round protrusion rows) to the width L of the plate 2 falls within the range of 0.89 to 1.5 mm, so that the flowability of refrigerant flowing between the small, round protrusions 25 is improved and the turbulent flow of the refrigerant is desirable generated, thereby achieving the optimum efficiency of heat exchange.

Second, the width Gs of the passage between the outlet-side flange portion 29 and the small, round protrusion 25 nearest to the outlet-side flange portion 29 is designed to fall within the range of 0.15 to 1.6 mm, so that the non-uniform flow the refrigerant is prevented while refrigerant flows through the U-turn portion 27, thereby improving the flowability of the refrigerant and accordingly improving the efficiency of heat exchange.

Third, for the purpose of eliminating the phenomenon that the flow of refrigerant is resisted by the burr portion 221 inserted into the second manifold plate 2L2 while the refrigerant flows toward the end plate 5L, the size of the first slot 22A of the first manifold plate 2L1 is designed to be less than the size of the second slot 22A' of the second manifold plate 2L2, thereby making uniform the flow rate of refrigerant flowing toward the end plate 5 and the flow rate of refrigerant flowing toward the blank plate. Accordingly, whether the heat exchanger is mounted in either a top mounting fashion or a bottom mounting fashion, the flow distribution of refrigerant is balanced. Hence, the heat exchanger can be used for top and bottom mounting fashions without any difference in the performance of heat exchange, thereby increasing the productivity in the manufacture of a heat exchange and reducing the manufacturing cost of the heat exchanger.

Fourth, three short vertical protrusions 26A, 26B, 26A are formed under one cup portion 21 side by side, and both side vertical protrusions 26A, 26A are respectively horizontally extended to the longitudinal partition protrusion 24 and the neighboring portion of the flange 29, so that the flow distribution of the refrigerant flowing into the neighboring pockets 11A through the slots 22 and the flow distribution of the refrigerant flowing into the heat exchange portion 23 through the vertical passages formed by protrusions 26A, 26B 26A are made uniform, thereby achieving the uniform flow distribution of the refrigerant over the entire heat exchanger and accordingly improving the performance of heat exchange further.

Fifth, a plurality of round reinforcing protrusions 25A, 25A, 25B are formed along the lower, imaginary prolongation line of the longitudinal partition protrusion 24 while being arranged together with the other small, round protrusions 25 in the pattern of a diagonal lattice, so that the strength of the attachment of two plate 2 in the U-turn portion 27 is enhanced, thereby improving the durability of the flat tube 1. Additionally, the two plates 2 are not easily separated from each other, so that leakage of the refrigerant can be prevented.

Sixth, the two diagonal protrusions 28 are respectively formed on both corners of the U-turn portion 27, so that the strength of the attachment of the two plates 2 in the U-turn portion 27 is enhanced further. Additionally, the flow resistance against the refrigerant and pressure of the refrigerant is reduced, so that the flowability of refrigerant is improved, thereby improving the performance of heat exchange.

Seventh, the spacer 133 inserted around the manifold portion 13 of the manifold tubes 1L, 1R can enhance the strength of the manifold portion 13 to resist the bending moment exerted thereon when the inflow pipe or outflow pipe is bent during mounting the heat exchanger to the vehicle body.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat exchanger having a manifold plate structure, comprising:

a first end plate and a second end plate, each end plate being configured on a respective side end of the heat exchanger; and a plurality of flat tubes, the flat tubes being stacked together so that plates constituting the flat tubes are arranged in the order of the second end plate, a first plurality of pairs of plates, a first pair of manifold plates to which a refrigerant inflow pipe is connected, the first pair of manifold plates having a first manifold plate which is located at a side of the first end plate and second manifold plate which is located at a side of the second end plate, a second plurality of pairs of plates, a second pair of manifold plates to which a refrigerant outflow pipe is connected and a third plurality of pairs of plates configured adjacent to the first end plate;

wherein a first burr portion projected from an edge of an inlet-side slot of the first manifold plate to an outside is fixedly inserted into a first slot of a plate among the second plurality of pairs of plates adjacent to the first manifold plate, and a second burr portion projected from an edge of a second slot of a plate among the first plurality of pairs of plates adjacent to the second manifold plate is fixedly inserted into an inlet-side slot of the second manifold plate, and wherein each of the length and width of the first slot and the length and width of the inlet-side slot of the first manifold plate is less than the length and width of the inlet-side slot of the second manifold plate, respectively.

2. A heat exchanger having a manifold plate structure, comprising:

a first and a second manifold plate configured to allow a refrigerant communication between an outside of the heat exchanger and another plate, the manifold plates together forming a closed flat tube and each having a pair of cup portions, the first manifold plate having a first slot and the second manifold plate having a second slot, the edge of the first slot having a projected burr portion;

wherein the first slot is configured for insertion into a slot of a first adjacent plate that is configured to be connected to the first manifold plate; and wherein the length and width of the first slot are less than the length and width of the second slot, respectively.

3. The heat exchanger of claim 2, further comprising a second adjacent plate having a pair of cup portions, wherein at least one of the cup portions has a third slot having a burr portion that is projected from the edge of the third slot, and the third slot is configured for insertion into the second slot through a respective cup portion.

4. The heat exchanger of claim 2, wherein the first slot is about 15 mm long and about 9 mm wide, while the second slot is about 16.6 mm long and about 10.8 mm wide.

5. The heat exchanger of claim 2, further comprising:

a heat exchange portion, communicating with the cup portions of the manifold plates, having a plurality of small protrusions, and being divided into two sub-portions by a central longitudinal partition protrusion; and a flange having the same height as that of the small protrusions, the flange being formed along the edge of the manifold plates;

wherein several vertical protrusions are formed side by side on an inlet-side sub-portion of the heat exchange portion under the inlet-side cup portion of the cup portions, both side vertical protrusions being respectively horizontally extended to the longitudinal partition protrusion and to a neighboring portion of the flange.

* * * * *